US012359391B2

(12) United States Patent
Sharpe et al.

(10) Patent No.: US 12,359,391 B2
(45) Date of Patent: Jul. 15, 2025

(54) MODULAR ACCESS COVER

(71) Applicants: ACCESS TECHNICAL CENTRE PTY LTD, Victoria (AU); ACCESS COVERS AUSTRALIA PTY LTD, Victoria (AU)

(72) Inventors: James Sharpe, Victoria (AU); Luca Giacomin, Victoria (AU)

(73) Assignees: Access Technical Centre Pty Ltd, Victoria (AU); Access Covers Australia Pty Ltd, Victoria (AU)

( * ) Notice: Subject to any disclaimer, the term of this patent is extended or adjusted under 35 U.S.C. 154(b) by 899 days.

(21) Appl. No.: 17/614,325

(22) PCT Filed: May 27, 2020

(86) PCT No.: PCT/AU2020/050533

§ 371 (c)(1),
(2) Date: Nov. 24, 2021

(87) PCT Pub. No.: WO2020/237309

PCT Pub. Date: Dec. 3, 2020

(65) Prior Publication Data

US 2022/0220693 A1 Jul. 14, 2022

(30) Foreign Application Priority Data

May 27, 2019 (AU) ..... 2019100559

(51) Int. Cl.
*E02D 29/14* (2006.01)

(52) U.S. Cl.
CPC ..... *E02D 29/1418* (2013.01); *E02D 29/1445* (2013.01); *E02D 29/1481* (2013.01); *E02D 2200/1628* (2013.01); *E02D 2300/002* (2013.01)

(58) Field of Classification Search
CPC ..... E01D 29/1418; E01D 29/1445; E01D 29/1481; E01D 2200/1628; E01D 2300/002
(Continued)

(56) References Cited

U.S. PATENT DOCUMENTS 7,467,910 B2 * 12/2008 Lecuyer ..... E04G 21/142 404/70
7,931,421 B2 * 4/2011 Rathmann ..... E03F 5/06 404/2
(Continued)

FOREIGN PATENT DOCUMENTS

AU 200066625 4/2001
AU 200066625 A1 4/2001
(Continued)

OTHER PUBLICATIONS

Gatic, Gatic Product Catalogue: Access Covers Grates & Accessories, published 2011, (online catalogue) [retrieved from internet Aug. 7, 2020], https://www.iplex.com.au/assets/Uploads/7805f13dee/Gatic-Technical-Guide.pdf, pp. 23-28 & 54.
(Continued)

*Primary Examiner* — Raymond W Addie
(74) *Attorney, Agent, or Firm* — Dierker & Kavanaugh, P.C.

(57) ABSTRACT

Embodiments generally relate to modular access covers. Example embodiments relate to an access cover assembly comprising: a first set of modular access covers and a second set of modular access covers, wherein in each set, adjacent covers are coupled; and a support frame comprising end frame pieces, side frame pieces, wall boxes, and a support beam. The end frame pieces and side frame pieces define a support plane to support the first and second sets of modular access covers. The wall boxes define a support surface to support the support beam and the end frame pieces, and the
(Continued)

support surface is offset from the support plane and the wall boxes are connected to the end frame pieces and receive respective ends of the support beam.

20 Claims, 15 Drawing Sheets

(58) Field of Classification Search
USPC ..... 404/25; 52/19
See application file for complete search history.

(56) References Cited

U.S. PATENT DOCUMENTS 8,869,452 B2 * 10/2014 Royer ..... E02D 29/14 49/400
8,887,643 B2 * 11/2014 Goding ..... B61F 5/36 105/82
8,920,072 B2 * 12/2014 Humphries ..... E03F 3/046 404/4
8,998,528 B2 * 4/2015 Boca ..... E02D 29/1427 404/25
2010/0329782 A1 * 12/2010 Miller ..... E02D 29/14 404/25

FOREIGN PATENT DOCUMENTS

| | | | |
|---|---|---|---|
| AU | 775884 | B2 | 8/2004 |
| CN | 204225152 | U | 3/2015 |
| CN | 206616598 | U | 11/2017 |
| GB | 2404409 | A | 2/2005 |
| JP | 2002242217 | A | 8/2002 |
| JP | 2008082058 | | 4/2008 |

OTHER PUBLICATIONS

Tellam, Tellam Civil Products, published Jul. 2016, (online catalogue) [retrieved from internet Aug. 7, 2020], https://tellam.com.au/catalogue.pdf, p. 73 (Telstra Covers & Frames).

* cited by examiner

MODULAR ACCESS COVER

TECHNICAL FIELD

The present disclosure is directed towards access covers, such as may be used in industrial applications to cover large openings.

BACKGROUND

Access covers are used to prevent unauthorised access to controlled areas, such as water and electrical infrastructure pits or other underground areas, by blocking the entrance or opening which leads into the controlled area.

Infrastructure pits are concrete structures which provide access to underground or underfloor services, such as sewer pipes and electrical cables. The openings to these infrastructure pits may be at ground or floor level, and covered by an access cover which when installed is aligned to sit substantially level with the surrounding ground or floor structure. In this way, the access cover does not form a tripping hazard.

In order for the access cover to sit flush with the ground, a step or rebate is formed in the surrounding concrete to support the edges of the access cover. Forming steps in the concrete can be time-consuming, especially if the shape of the access cover is complex. The size and quantity of the steps or rebates to be formed in the surrounding concrete may be affected by the size of the opening.

The size of the opening also affects the size of the access cover. Generally, the larger the access cover, the heavier, bulkier, and more unwieldy it is to handle. Modular or multi-part access covers allow smaller and lighter individual covers to be joined together to cover a large opening, which provides handling efficiencies compared to using a single large access cover to cover the same opening.

It is desired to address or ameliorate one or more shortcomings associated with prior access covers, or to at least provide a useful alternative thereto.

SUMMARY

Some embodiments relate to an access cover assembly comprising:

- a first set of modular access covers and a second set of modular access covers, wherein in each set, adjacent covers are coupled; and
- a support frame comprising end frame pieces, side frame pieces, wall boxes, and a support beam;
- wherein the end frame pieces and side frame pieces define a support plane to support the first and second sets of modular access covers;
- wherein the wall boxes define a support surface to support the support beam and the end frame pieces, wherein the support surface is offset from the support plane and wherein the wall boxes are connected to the end frame pieces and receive respective ends of the support beam; and
- wherein the end frame pieces, side frame pieces and the support beam define first and second recessed portions of the support frame which respectively receive and support the first and second sets of modular access covers on the support plane.

The support beam may divide the first set of modular access covers from the second set of modular access covers. The support frame may be configured to be set into a concrete foundation which defines an opening to an underground or underfloor area.

The support frame may further comprise corner pieces, wherein each one of the corner pieces connects the end frame pieces and the side frame pieces at an angle to define a corner of the support frame. The end frame pieces or the side frame pieces may comprise a plurality of modular side frame members connected end-to-end.

The end frame pieces, side frame pieces, wall boxes, and corner pieces may each comprise a ledge that defines an upper surface which extends from a wall, wherein the upper surface of each ledge extends along and partly defines the support plane. Each one of the end frame pieces, side frame pieces, wall boxes, and corner pieces may have: (i) a drawcut configuration, wherein an angle between the wall and the ledge is an obtuse angle; or (ii) an undercut configuration, wherein the angle between the wall and the ledge is an acute angle.

At least one first modular access cover of the first set of modular access covers and at least one second modular access cover of the second set of modular access covers may comprise: a base plate, oppositely disposed first and second end walls, and a first connecting portion disposed adjacent the first end wall.

The first connecting portion of each at least one first modular access cover and each at least one second modular access cover may be configured to align with a second connecting portion adjacent the second end wall of an adjacent modular access cover to allow fixed coupling of adjacent modular access covers. The second connecting portion may include a projecting tab that comprises a tab body which substantially spans part of a length of the second end wall.

The first connecting portion may define a bore, wherein the bore may be configured to receive a connector and to guide the connector to engage with the tab body when the first connecting portion is aligned with the second connecting portion, to thereby fixedly couple the adjacent modular access covers.

The end walls and the first connecting portion of the at least one first modular access cover and/or the at least one second modular access cover may be integrally formed with the base plate.

The connected ones of the first set of modular access covers may be detachable from each other and connected ones of the second set of modular access covers may be detachable from each other. The first set of modular access covers and the second set of modular access covers may comprise different numbers and/or sizes of modular access covers.

The first and second sets of modular access covers and the support beam may be detachable from the respective end and side frame pieces to permit access through the opening to the underground or underfloor area.

Some embodiments relate to a support beam for an access cover assembly, the support beam comprising:

- a support surface for supporting an edge of at least one modular access cover;
- a first wall and a first end surface at a first end of the support beam, and a second wall and a second end surface at a second end of the support beam; and
- a plurality of stiffeners disposed along the support beam between the first and second ends;
- wherein an angle between the first wall and the support surface is an obtuse angle to form a drawcut configuration;
- wherein an angle between the second wall and the support surface is an acute angle to form an undercut configuration; and wherein the first and second end surfaces are configured to engage with first and second wall boxes, and the first and second end surfaces are substantially coplanar with the support surface.

The support surface may comprise first and second laterally opposite support surfaces.

The support beam may be integrally-formed through: (i) a metal casting process; or (ii) a moulding process; or (iii) a fibreglass composite lay-up process.

A web of the support beam may define a first lifting aperture at the first end of the support beam, and a second lifting aperture at the second end of the support beam. The web may taper at the first and second ends of the support beam.

Some embodiments relate to method of assembling the access cover assembly of embodiments described herein, the method comprising:

connecting the end frame pieces, side frame pieces, wall boxes, and the support beam to form the support frame;

positioning the first set of modular access covers and the second set of modular access covers in the first and second recessed portions respectively.

The method may further comprise bolting the first set of modular access covers together, bolting the second set of modular access covers together, and bolting the first and second sets of modular access covers to the support frame to secure the first and second sets in the respective first and second recessed portions.

Some embodiments relate to a modular access cover, comprising:

a base plate having first and second end walls, and side walls;

ribs disposed on the base plate and connecting the end walls and side walls to define a series of cavities; and a connecting portion adjacent the second end wall;

wherein an angle between the first end wall and the base plate is an acute angle to form an undercut configuration, and wherein an angle between the second end wall and the base plate is an obtuse angle to form a drawcut configuration;

wherein the connecting portion is configured to allow fixed coupling of the modular access cover to an adjacent modular access cover; and wherein the series of cavities is configured to receive and contain a filler material.

The modular access cover may further comprise a tab which extends outwards from the first end wall, the tab having a tab body which defines a tab hole and a supporting surface.

A length of the tab body may be at least approximately 50% of the length of the first end wall. The length of the tab body may be at least approximately 70% of the length of the first end wall. The tab body may extend outwards along the length of the first end wall. The tab body may extend equally outwards along the length of the tab body.

The connecting portion may overlap the supporting surface of the tab of an adjacent modular access cover. The connecting portion may comprise a body which defines a bore, the bore configured to receive a connector and guide the connector to engage with the tab hole of an adjacent modular access cover and allow fixed coupling of the modular access cover and the adjacent modular access covers.

The base plate may comprise a reverse surface disposed opposite the ribs, and wherein the reverse surface and the supporting surface of the tab body are substantially coplanar. The base plate, ribs, end walls and side walls may be integrally formed. A height of the end walls and side walls above the base plate may be equivalent to a height of the ribs above the base plate.

BRIEF DESCRIPTION OF DRAWINGS

Embodiments are described in further detail below, by way of example, with reference to the accompanying drawings, in which.

DETAILED DESCRIPTION

Figure 1:
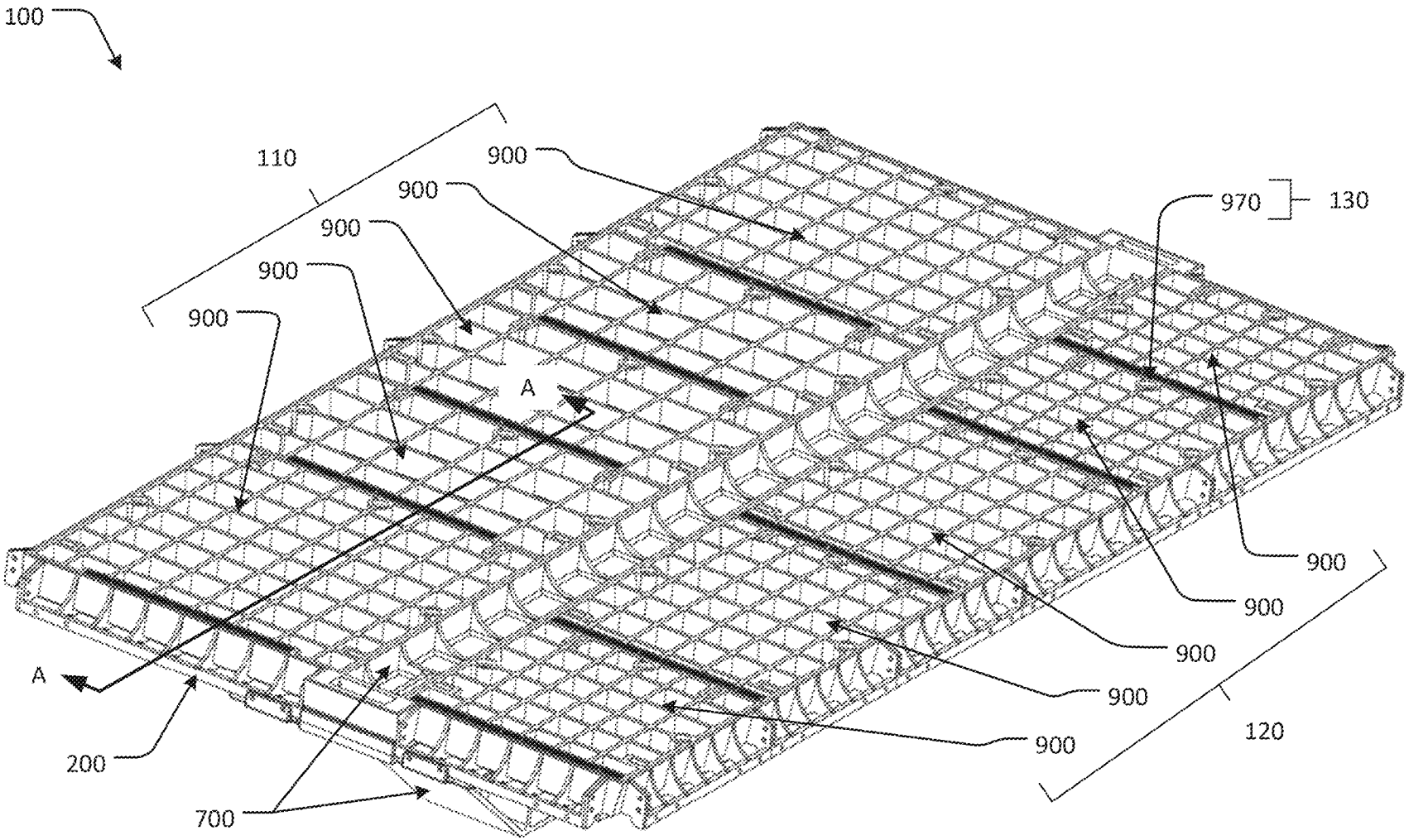
FIG. 1 is a perspective view of a modular access cover assembly, according to some embodiments.

The present disclosure is directed towards access covers. Access covers may be assembled into a single structure, which may be made of steel, for example. Some covers have cavities that are filled with a filler material, such as concrete, to add weight and strength to the cover.

The size of existing single-piece covers is limited by the materials used. For example, a single-piece cover would typically weigh 300 kg/$m^2$. Openings may range in size from 1 $m^2$ to 80 $m^2$, for example. Typically, lifting the cover is performed by two or more workers using a lifting tool which engages with sockets built into the cover. The size of the cover is thereby restricted to allow workers to safely manually lift the cover and avoid the need for powered lifting equipment such as hydraulic jacks or forklifts.

According to the Australian Standard 3996-2019, the serviceability design load for the access cover may ranging from 6.7 kN to 600 kN, depending on the load class (usage) of the cover. For example, Class A covers are typically used in areas accessed by pedestrians only; Class B covers in areas for low-speed vehicular access; Classes C, D and E covers in areas where higher-speed vehicular access is required; and Classes F and G for industrial areas such as docks, wharves, and airports.

Modular or multi-part access covers allow a larger opening to be covered without suffering from the size and weight limitations. Specifically, a larger opening can be covered by an assembly of interconnected access covers, with each of the interconnected access covers having similar size and weight to the single-piece cover. This may, for example, allow individual covers to be manually lifted in and out of position while enabling coverage of a larger opening compared to single-piece covers.

The present disclosure includes an access cover assembly for covering an opening to an underground or underfloor area. The assembly is designed to be load bearing, and may for example be designed to cater to a range of load classes (Classes A-G) as described in the Australian Standard 3996-2019. The assembly comprises a support frame which is set into a step or rebate that is cut or formed into the perimeter of the opening. The support frame includes a recessed portion which is configured to receive and support a plurality of modular covers, thereby covering the opening. The recessed portion may include a combination of undercut and drawcut surfaces, which engage with corresponding undercut and drawcut surfaces of the modular covers to retain the modular covers in the support frame. The support frame further comprises a support beam, which spans the opening and provides additional support to the modular covers. In particular, the support beam tapers towards its ends, where it meets the support frame. This allows the ends of the support beam to connect to the support frame (via structures called wall boxes) at the same height of the step or rebate. In this way, a deeper additional step or rebate does not need to be formed into the existing step or rebate, thereby simplifying construction at the installation site.

Figure 9:
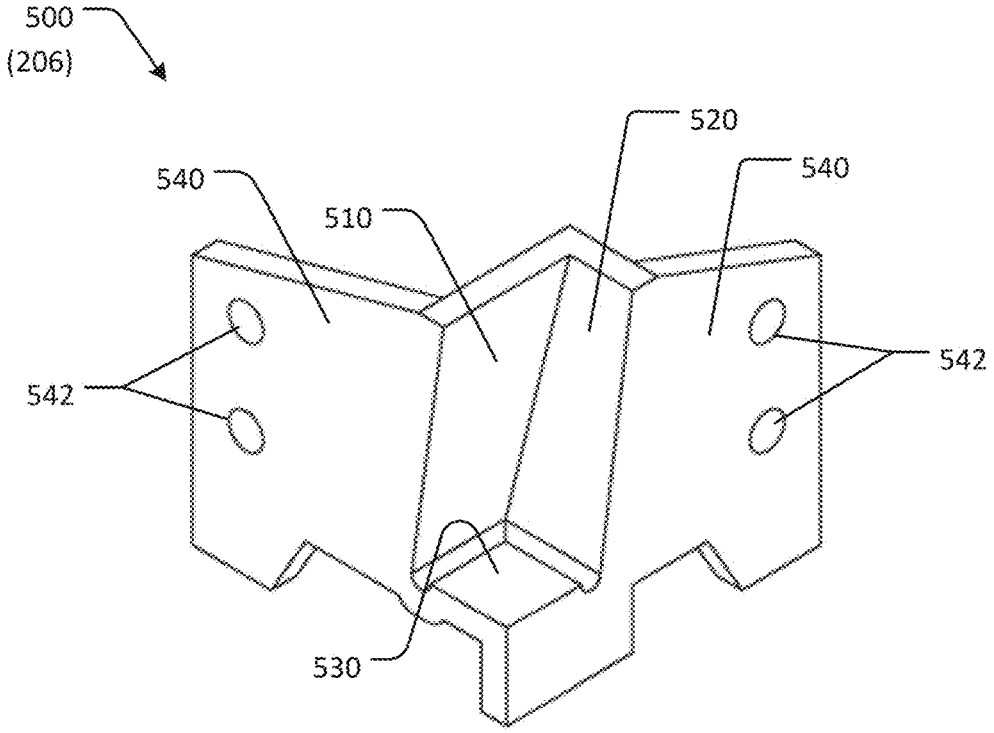
FIG. 9 is a perspective view of a right-handed undercut corner piece for the frame of FIG. 2, according to some embodiments.

FIG. 1 shows an access cover assembly 100 for covering an opening, such as the opening to an underground or underfloor area. The access cover assembly 100 comprises a first set of modular access covers 110 and a second set of modular access covers 120. The first and second sets of modular access covers 110, 120 each comprise a plurality of modular access covers, such as covers 900 (FIG. 9). The individual covers 900 in each set 110, 120 may be any shape and may be different from each other, but are preferably rectangular-shaped for ease of manufacturing, installation, and combination with other covers 900. In some embodiments, the first set and the second set of modular access covers 110, 120 each comprise different numbers and/or sizes of the modular access covers.

The individual covers 900 in each set 110, 120 are placed adjacent to each other, and the adjacent covers 900 are coupled. Coupling the covers 900 is achieved by placing adjacent covers 900 in contact with each other. A retainer 130 may be used to maintain the desired level of contact between adjacent covers 900, so that the covers 900 may be able to resist an applied load, such as a person standing on the cover 900. For example, the retainer 130 may be a moulding or specially-shaped feature that is integrally-formed with or attached to all or some of the individual covers 900 so that the cover 900 is able to support any adjacent covers 900. In some embodiments of the assembly 100, a fastener such as a bolt, pin, or rivet may be used to further secure the covers 900 once they are coupled and retained in place by the retainer 130. The retainer 130 may be used to collectively refer to the connecting portion 970 and the tab 980 later disclosed herein in relation to FIG. 14. Fasteners used to couple covers 900 together are preferably removably engageable with the covers 900 in order to facilitate decoupling of the covers 900 when access through the cover assembly 100 is required.

The assembly 100 further comprises a support frame 200 for supporting and holding the first and second sets of covers 110, 120 in place. The support frame 200 is placed in contact with the structure surrounding the opening to be covered by the assembly 100. For example, the structure surrounding the opening may be a pavement or concrete slab, which defines the opening to an underground or underfloor area. In applications where it is desired for the access cover assembly 100 to sit flush with the ground, a step or rebate is formed in the surrounding structure. The support frame 200 sits on this step or rebate, and the loads applied to the assembled cover 100 are transferred to the surrounding structure.

Figure 2:
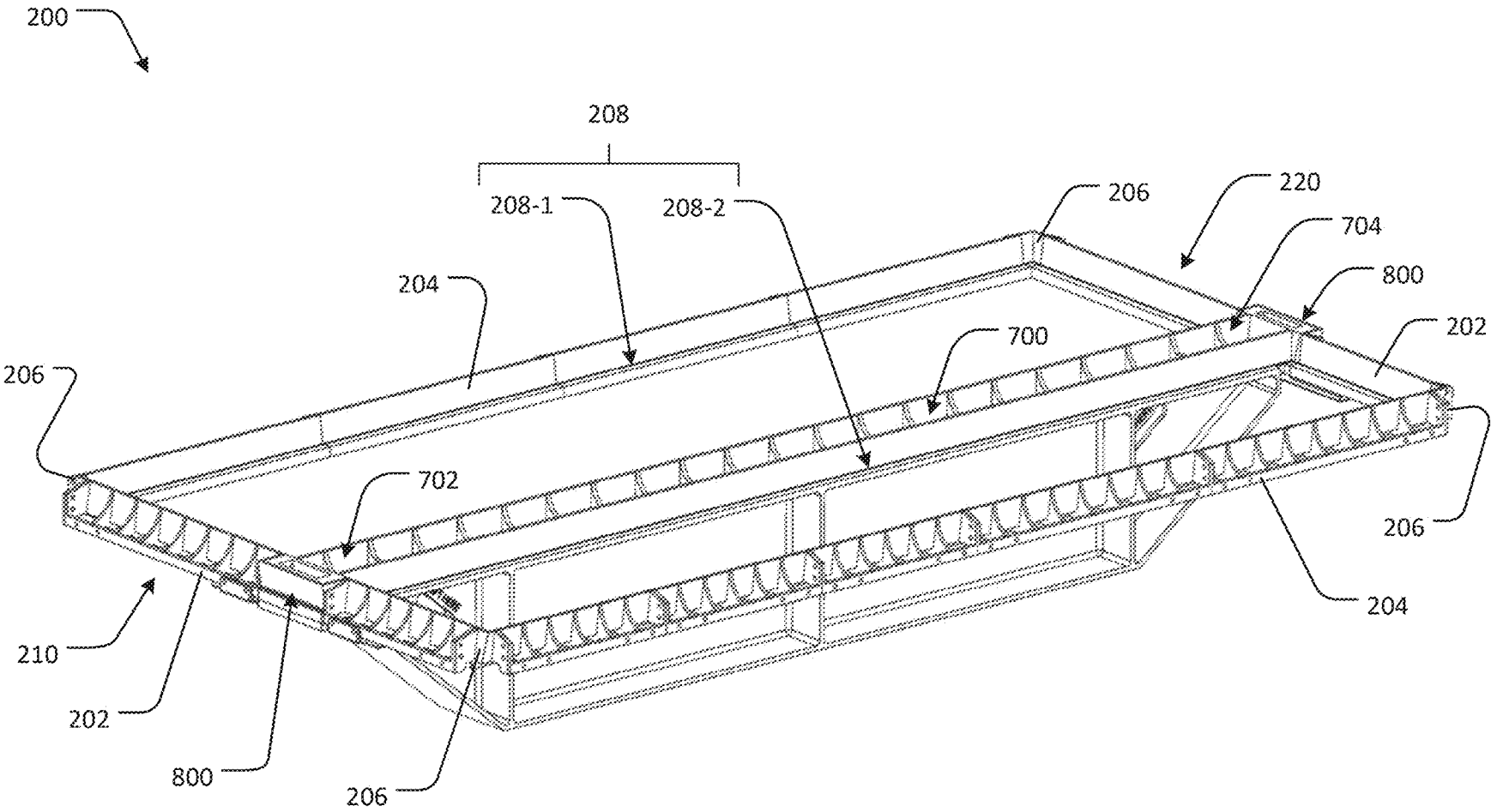
FIG. 2 is a perspective view of a support frame for the modular access cover assembly of FIG. 1, according to some embodiments.

FIG. 2 shows an example support frame 200 in more detail, with the first and second sets of covers 110, 120 removed for clarity. The support frame 200 comprises end frame pieces 202 and side frame pieces 204. The end frame pieces 202 and/or the side frame pieces 204 may comprise a plurality of modular frame pieces 300, 400 (FIGS. 4 and 6) connected end-to-end. In some embodiments, the side frame pieces 204 comprise a flange or other means to connect to an end frame piece 202, or vice versa. The support frame 200 may additionally comprise corner pieces 206, wherein the corner pieces 206 connect one of the end frame pieces 202 to one of the side frame pieces 204 at an angle to thereby define a corner of the support frame 200.

When the various frame pieces 202, 204 and corner pieces 206 are assembled to form the support frame, the end frame pieces define a first end 210 and a second end 220 of the support frame 200. The first end 210 and the second end 220 may be oppositely disposed, and perpendicularly connected by the corner pieces 206 to the side frame pieces 204 to define a rectangle-shaped support frame 200. Other shapes of support frame 200 are possible by connecting the side frame pieces 204 to each other via corner pieces 206 set at desired angles, such as at 45° or at 60°. This modular approach means a variety of frame and panel sizes can be combined to enable various shapes of openings to be covered.

The end frame pieces 202, side frame pieces 204, and corner pieces 206 combine to define a recessed portion 208 to receive the first and second sets of modular access covers 110, 120 in the frame 200. The recessed portion 208 consists of undercut and drawcut surfaces in order to retain the first and second sets of covers 110, 120 in the frame 200. As described in more detail in relation to FIGS. 4 to 7, an undercut is defined as an acute angle, while a drawcut is define as an obtuse angle. The individual covers (900, FIG. 14) comprise at least one undercut side which is retained in an corresponding undercut surface of the recessed portion 208. The remaining surfaces of the recessed portion 208 may be drawcut to correspond to the drawcut sides of the covers 900.

Figure 14:
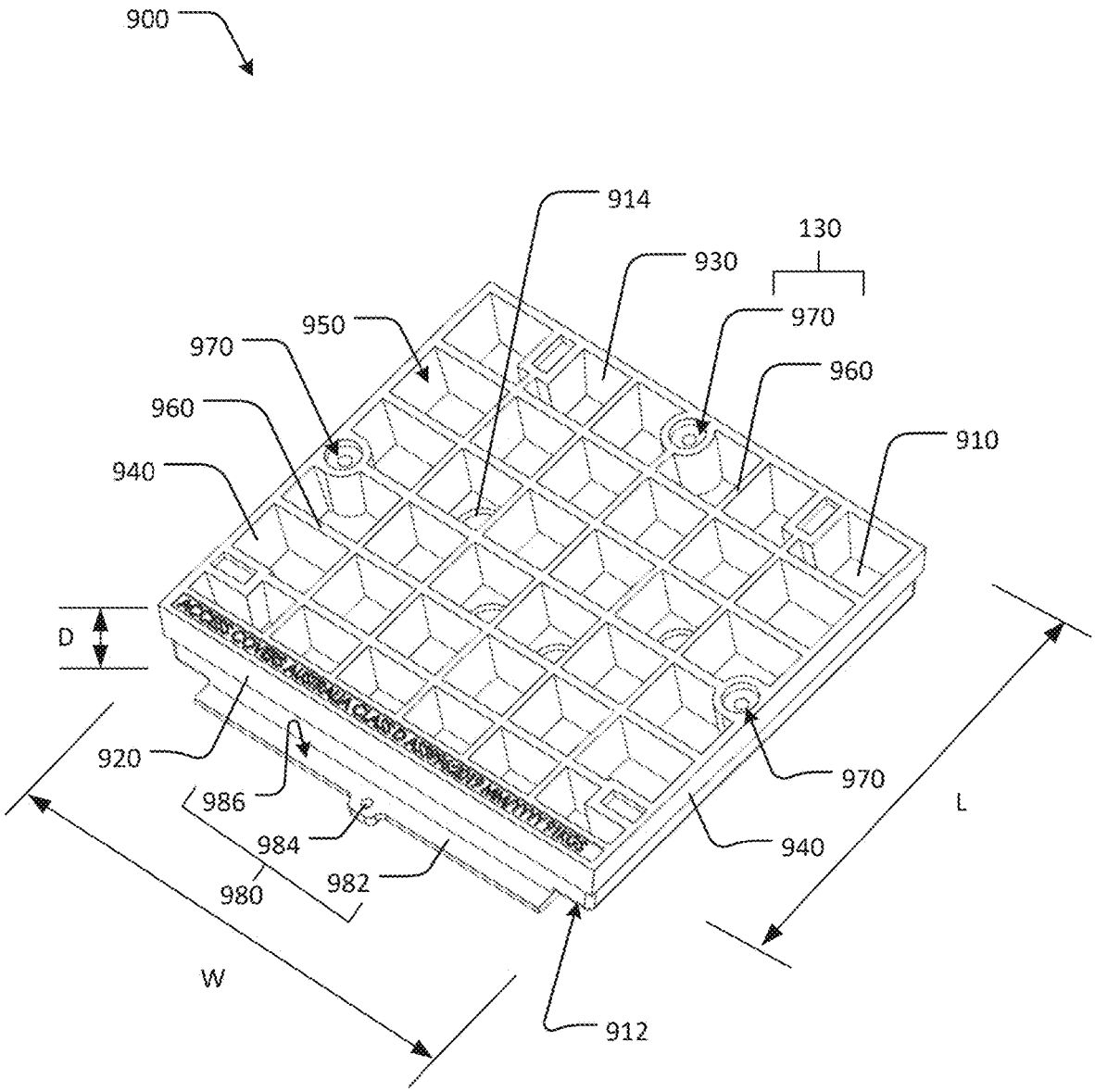
FIG. 14 is a perspective view of a modular access cover in the assembly of FIG. 1, according to some embodiments.

In some embodiments, such as shown in FIG. 14, the individual covers are rectangular, with one undercut side and the remaining three sides being drawcut. When the covers 900 are placed into the rectangular frame 200, the covers 900 are aligned with the end and side frame pieces 202, 204 so that each individual cover 900 has its side walls 940 supported by the side frame pieces 204, and its end walls 920, 930 supported by adjacent covers 900 and/or the end frame pieces 202.

In some embodiments, the access cover assembly 100 and support frame 200 are generally symmetric about a longitudinal axis where the support beam 700 is supported in the middle of the end frame pieces 202 and a same combination of covers 900 can be located on each lateral side of the support beam 700. However, in various installations, symmetry may not be practically achievable or desirable. In some embodiments, the access cover assembly 100 and support frame 200 are generally asymmetric in at least along a longitudinal axis of the assembly 100. In asymmetrical assembly configurations, the position of the support beam 700 may be positioned closer to one side frame 204 than the other (opposite) side frame 204. The example access cover assembly 100 shown in FIG. 1 is asymmetrical about a central longitudinal axis that is parallel to the direction of extent of the support beam 700.

Figure 3A:
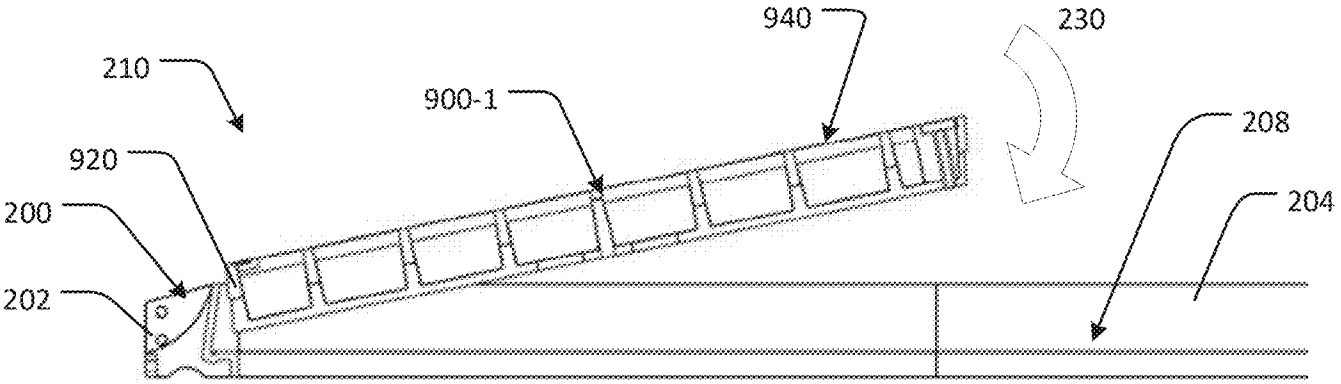
FIG. 3A is a section view of the modular access cover of FIG. 1, showing the assembly of the covers, according to some embodiments.
Figure 3B:
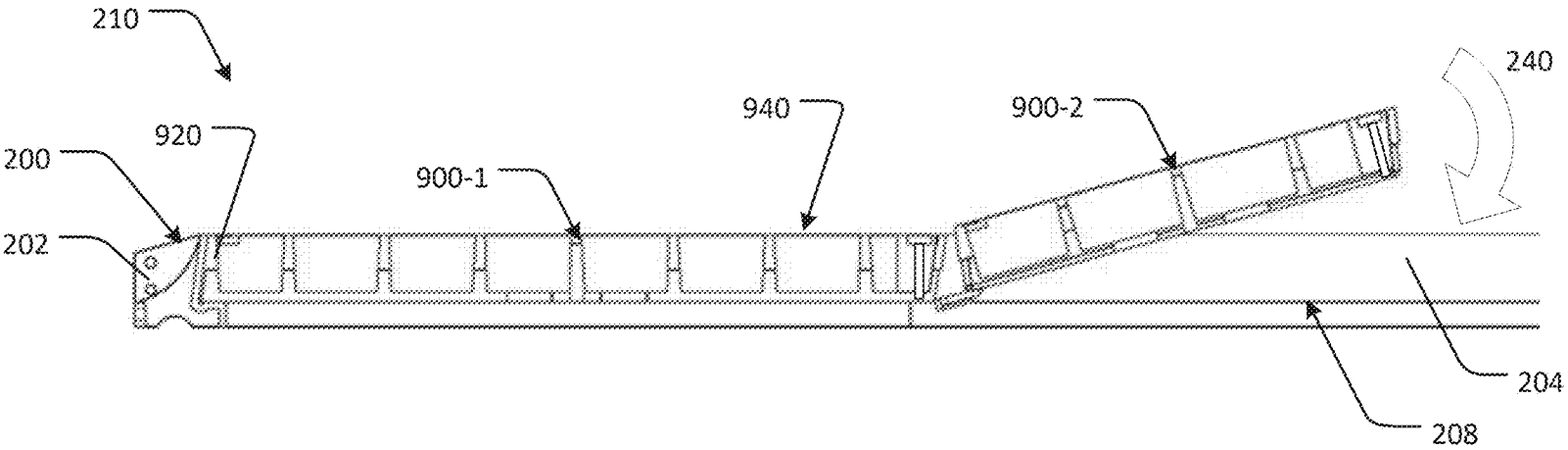
FIG. 3B is the same section view of FIG. 3A, showing a subsequent step in the assembly of the covers, according to some embodiments.

FIGS. 3A and 3B are partial cross-sections of the assembly 100, taken along the line A-A marked on FIG. 1. FIG. 3A shows an early stage of the placement of the individual covers 900 into the frame 200. Placing the individual covers 900 into the recessed portion 208 involves placing a first one 900-1 of the cover 900 into the first end 210. The cover 900 has an undercut side which is aligned with the undercut surface at the first end 210 in the recessed portion 208, as indicated by arrow 230. For example, the first end 210 of the support frame 200 may have undercut end frame pieces 202 to receive and support the undercut end wall 920 of the first individual cover 900-1. The side wall 940 of cover 900-1 is also aligned to be supported by the side frame piece 204.

Once the first individual cover 900-1 is in place, subsequent individual covers 900 are successively added into the recessed portion 208, as shown in FIG. 3B. As indicated by arrow 240, a second individual cover 900-2 is inserted into the recessed portion 208 and positioned so that its undercut side is aligned with the drawcut of the cover 900-1 already in place. This process is repeated with additional covers 900 until all the covers of the set 110, 120 are in place in the frame 200. In this way, each of the individual covers 900 in each of the sets 110, 120 has their undercut sides all aligned towards the same end of the support frame 200.

If the first end 210 of the support frame 200 has undercut end frame pieces (300, FIGS. 4 and 5), the second end 220 of the support frame 200 must have drawcut end frame pieces (400, FIGS. 6 and 7) in order to allow the last-installed cover 900 in the set 110, 120 to be inserted and removed. The side frame pieces 204 may be drawcut for the same reason.

In use, when a load is applied generally perpendicular to the first or second sets of covers 110, 120, the angle of the drawcut side walls 940 of the individual covers 900 converts this load into an axial load that pushes the covers 900 towards the first and second ends 210, 220 of the frame 200. In particular, the axial load forces the set of covers 110, 120 into the undercut at the first end 210 of the frame 200, which prevents the cover 900 from slipping out of the frame 200 at the first end 210. The set of covers 110, 120 may be fastened to the frame 200, for example by a bolt or similar retaining mechanism.

Figure 11:
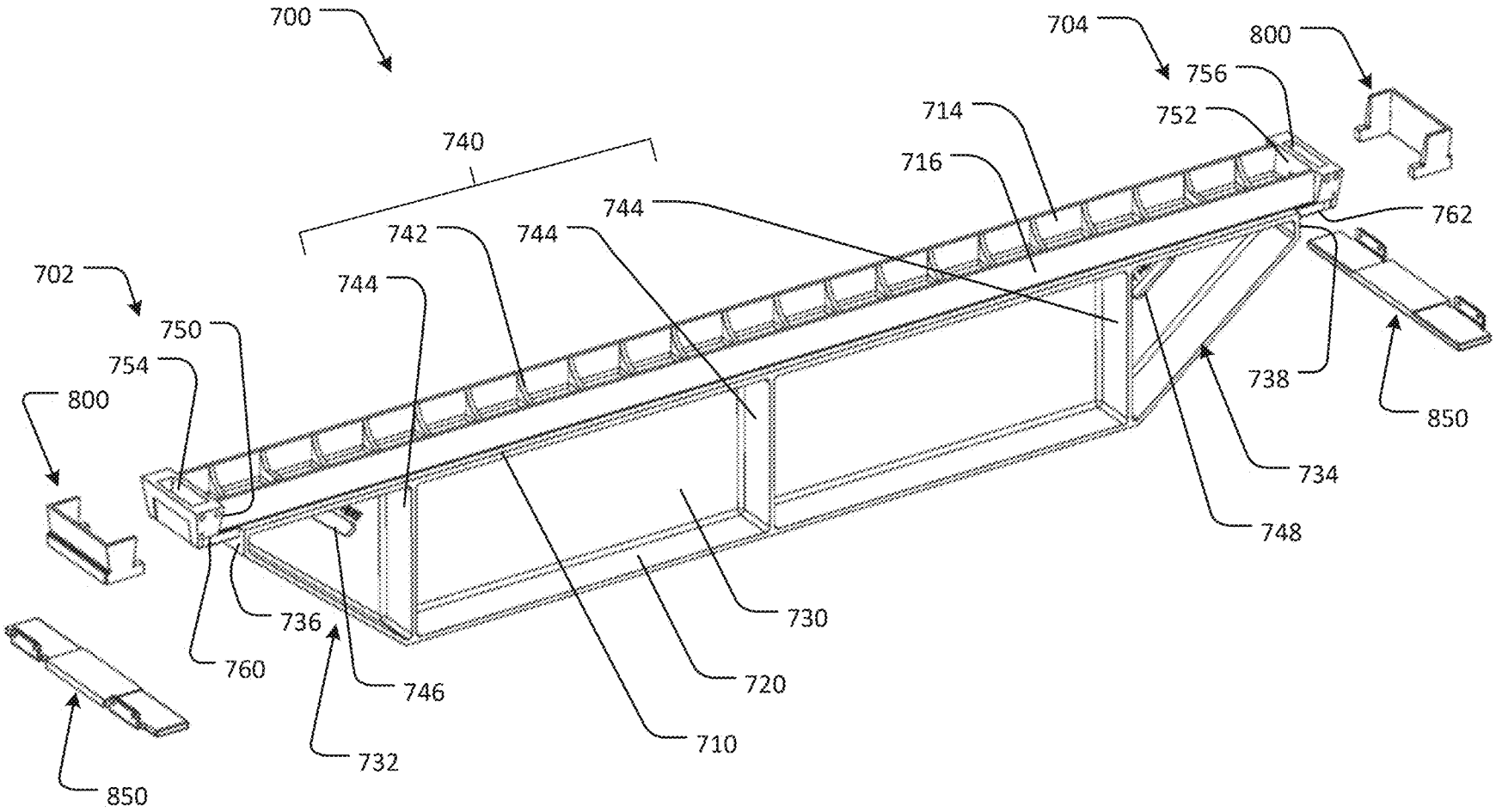
FIG. 11 is a perspective view of a support beam and wall boxes for the frame of FIG. 2, according to some embodiments.

Turning again to FIG. 2, with additional reference to FIG. 11, in some embodiments the support frame 200 further comprises a support beam 700 and wall boxes 800. The wall boxes 800 are shaped to correspond to each end of the support beam 700 to provide support to each end of the support beam 700. The support beam 700 has a first beam end 702 disposed opposite a second beam end 704; the first beam end 702 is connected to a first wall box 800, and the second beam end 704 is connected to a second wall box 800. The first and second wall boxes 800 are connected to the end frame pieces 202 at the first and second end 210, 220 respectively. Connecting the wall boxes 800 to the end frame pieces 202 allows beam loads to be transferred into the rest of the support frame 200.

The support beam 700 provides support to the edges of the first and second sets of covers 110, 120. In some embodiments, the support beam 700 divides the first set of modular access covers 110 from the second set of modular access covers 120, as shown in FIG. 1. In this way, each individual cover 900 in the first and second sets of modular access covers 110, 120 has at least two edges which are supported by the frame 200. For example, in the embodiment of the assembly 100 shown in FIG. 1, each individual cover 900 is rectangular-shaped and has one side edge supported by one of the side frame pieces 204, and the opposite side edge 204 supported by the support beam 700. Meanwhile, the end edges are supported by adjacent covers 900 and/or the end frame pieces 202.

Continuing to refer to FIG. 2, in embodiments of the support frame 200 comprising the support beam 700, the end frame pieces 202, side frame pieces 204 and the support beam 700 define first and second recessed portions 208-1, 208-2 of the support frame 200. The first recessed portion 208-1 receives and supports the first set of modular access covers 110, and the second recessed portion 208-2 receives and supports the second set of modular access covers 120. The recessed portions 208-1, 208-2 may enable upper portions of the first and second sets of covers 110, 120 to sit substantially level with an upper portion of the support frame 200.

When assembled, the end frame pieces 202, side frame pieces 204, and corner pieces 206 define a lower portion of the support frame 200. When the first and second sets of covers 110, 120 are placed in the recessed portions 208-1, 208-2, respective lower portions of the first and second sets of covers 110, 120 are aligned with the lower portion of the support frame 200.

Figure 4:
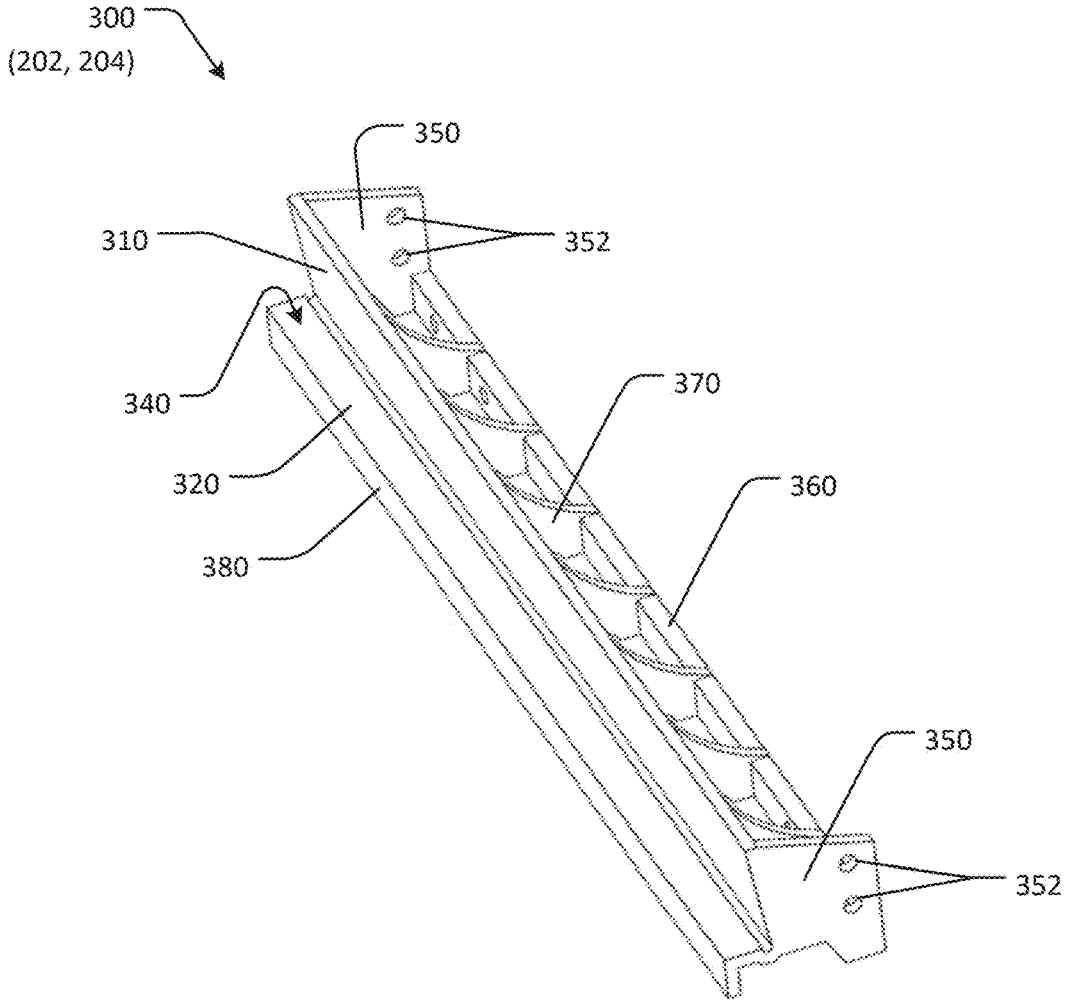
FIG. 4 is a perspective view of an undercut frame piece for the frame of FIG. 2, according to some embodiments.
Figure 5:
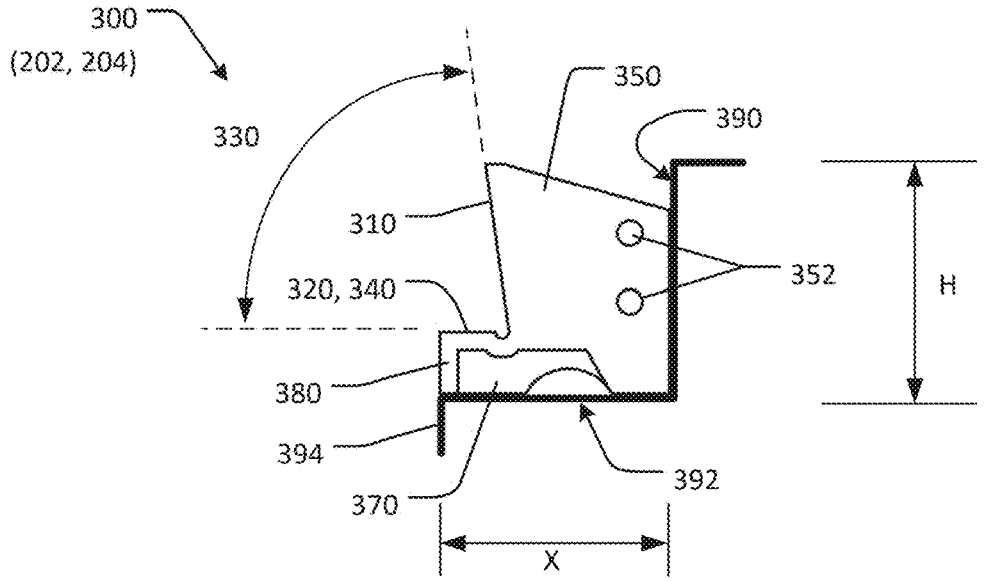
FIG. 5 is an end view of the frame piece of FIG. 4.
Figure 6:
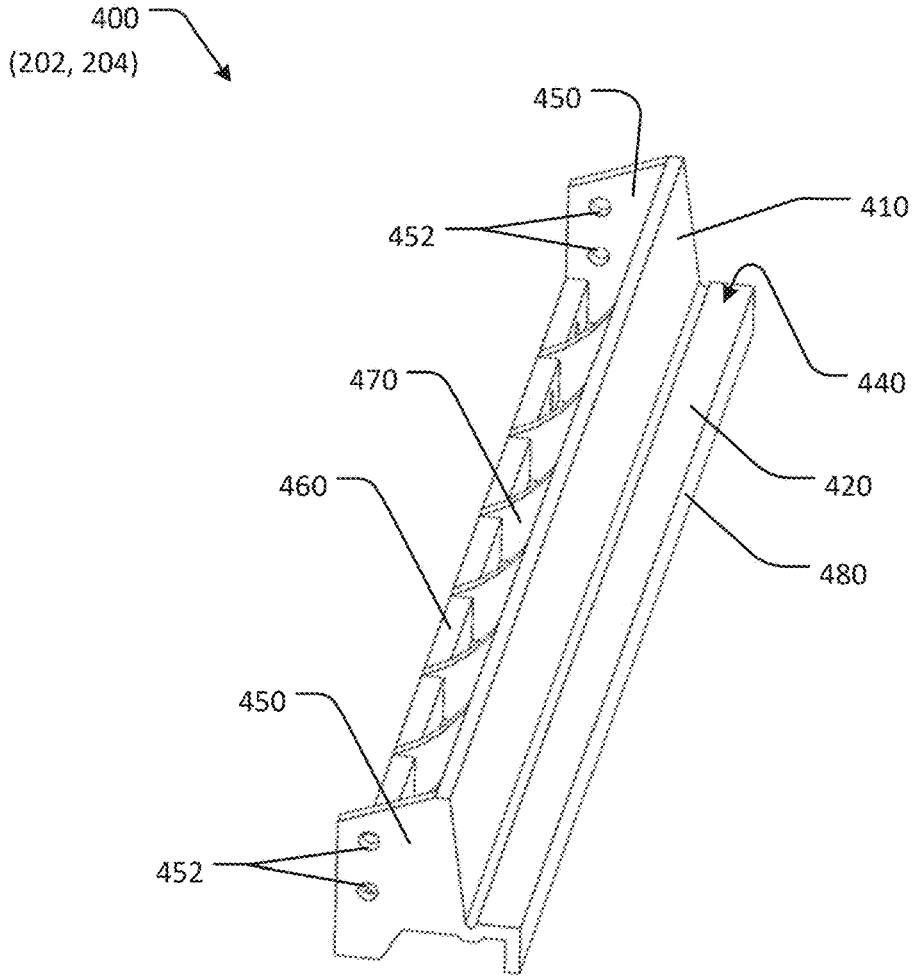
FIG. 6 is a perspective view of a drawcut frame piece for the frame of FIG. 2, according to some embodiments.
Figure 7:
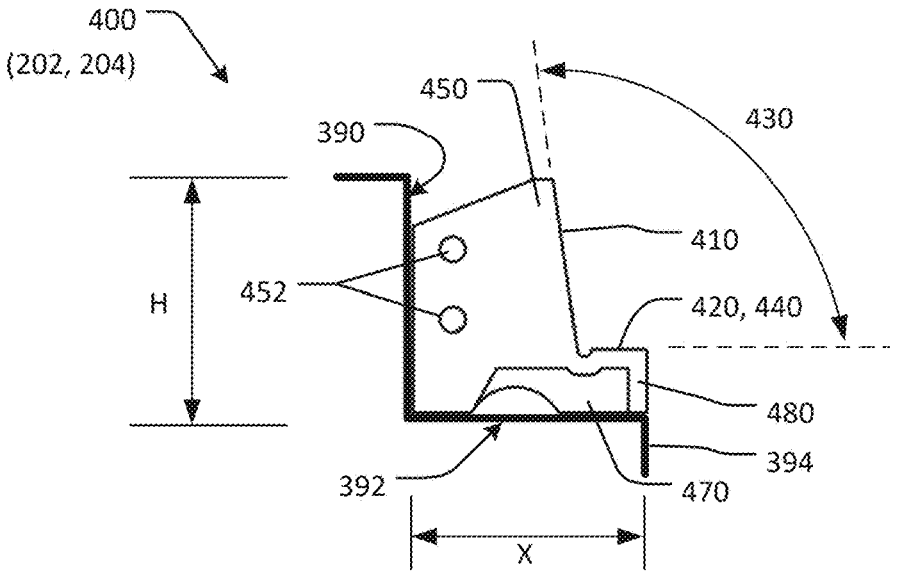
FIG. 7 is an end view of the frame piece of FIG. 6.

FIGS. 4 and 5 show an undercut embodiment of a frame piece 300. FIGS. 6 and 7 show a drawcut embodiment of a frame piece 400. In some embodiments, the frame pieces 300, 400 are modular, so that they may be used either as an end frame piece 202 or a side frame piece 204, with the only distinction being the location it is installed as part of the support frame 200.

FIG. 4 is a perspective view of the frame piece 300, and FIG. 6 is a perspective view of the frame piece 400. The frame pieces 300, 400 each comprise a wall 310, 410 and a ledge 320, 420 which extends from the wall 310, 410 at an angle 330, 430, as is more clearly shown in the end views of FIGS. 5 and 7. In particular, FIGS. 5 and 7 respectively show the frame pieces of FIGS. 4 and 6 as would be installed in a rebate surrounding an opening to be covered.

The angle 330, 430 between the ledge 320, 420 and the wall 310, 410 may be acute or obtuse, ranging approximately between 45° and 135°. In some embodiments, the angle 330, 430 ranges approximately between 70° and 110°. In some embodiments, the angle 330, 430 ranges approximately between 80° and 100°. If the angles 330, 430 are too acute or too obtuse, it may be more difficult to add and remove the covers 900 from the undercut and drawcut parts of the frame 200. In some embodiments, the angle 330, 430 is 82° or 98°, as this allows sufficient contact with the covers 900 in the undercut and drawcut parts of the frame 200, while allowing reasonable addition and removal of the covers 900. In some embodiments, the angle 330 is acute, and the frame piece 300 is said to have an undercut configuration, as shown in FIGS. 4 and 5. In the undercut configuration, the angle 330 may be approximately 82°. In some embodiments, the angle 430 is obtuse, the frame piece 400 is said to have a drawcut configuration, as shown in FIGS. 6 and 7. In the drawcut configuration, the angle 430 may be approximately 98°.

The wall 310 and the ledge 320 define the recessed portions of the support frame 200. As assembled, the frame pieces 300, 400 define a support plane 340, 440 of the assembly 100, wherein the support plane 340, 440 is coincident with the ledge 320, 420. The ledge 320, 420 is disposed in the lower portion of the support frame 200 and provides support to the lower portion of the individual cover 900. Specifically, when the bottom edge or surface (912, FIGS. 14 to 15B) of the cover 900 is placed in contact with the ledge 320, 420, the load applied to the cover 900 is transferred to the ledge 320, 420 and into the support frame 200.

Continuing to refer to FIGS. 4 to 7, the frame pieces 300, 400 further comprise end plates 350, 450, a base plate 360, 460, and stiffeners 370, 470. The end plates 350, 450 are placed at the ends of the wall 310, 410 and ledge 320, 420 to demarcate the end of the frame piece 300, 400 and provide some support to maintain the angle 330, 430 between the wall 310, 410 and ledge 320, 420. The end plate 350, 450 also provides a location for connecting adjacent frame pieces 300, 400. A series of holes 352, 452 may be formed in the end plate 350, 450 so as to accommodate a fastener, such as a bolt, and a nut tightened onto the bolt to adjoin and retain the end plate 350, 450 with the end plate 350, 450 of the adjacent frame piece 300, 400.

The base plate 360, 460 extends from the wall 310, 410 on an opposite side to the ledge 320, 420. As shown in FIGS. 5 and 7, the base plate 360, 460 is configured to be placed in contact with the structure 390 surrounding the opening, such as the step 392 or rebate. Alternatively, the step 392 may be cut or formed to be slightly larger than the frame piece 300, 400, as it may be too difficult or expensive to cut or form the structure to the exact dimensions required. Packers may then by placed on the step 392, and the frame piece 300, 400 placed on these packers. The packers may to bring the frame piece 300, 400 to the desired position on the step 392. To assist the frame piece 300, 400 with being located on the step 392 or edge of the surrounding structure 390, the ledge 320, 420 may comprise a lip 380, 480 which extends generally perpendicularly to the ledge 320, 420. When the frame piece 300, 400 is aligned on the step, the lip 380, 480 extends downward so that it abuts or is substantially coplanar with the sheer face 394 of the opening, thereby providing an indication that the frame piece 300, 400 is properly located on the step 392.

As shown in FIGS. 5 and 7, the distance X from the base plate 360, 460 to the lip 380, 480 sets the minimum width of the rebate required to accommodate the frame piece 300, 400. The distance X may be approximately 100 mm, or range between 50 mm and 200 mm. Meanwhile, the height H of the end plate 350, 450 sets the minimum depth of the rebate required to accommodate the frame piece 300, 400. Height H may be approximately 100 mm, or range between 50 mm and 200 mm.

As shown in FIGS. 4 and 6, the stiffeners 370, 470 connect the wall 310, 410 to the base plate 360, 460 and provide structural reinforcement to the frame piece 300, 400. The frame piece 300, 400 may comprise a plurality of the stiffeners 370 disposed between the end plates 350, 450. The number of stiffeners 370, 470 may vary according to the length of the frame piece 300, 400, as measured between the end plates 350, 450. The frame piece 300, 400 may range between 300 mm and 2000 mm in length. In some embodiments, the frame piece 300, 400 is 500 mm long, 750 mm long, or 1000 mm long. By way of example, the 500 mm-long frame piece 300, 400 has five of stiffeners 370, 470. The 750 mm-long frame piece 300, 400 has seven of stiffeners 370, 470. The 1000 mm-long frame piece 300, 400 has 11 of stiffeners 370, 470. The stiffeners 370, 470 may be equally disposed between the end plates 350, 450.

Figure 8:
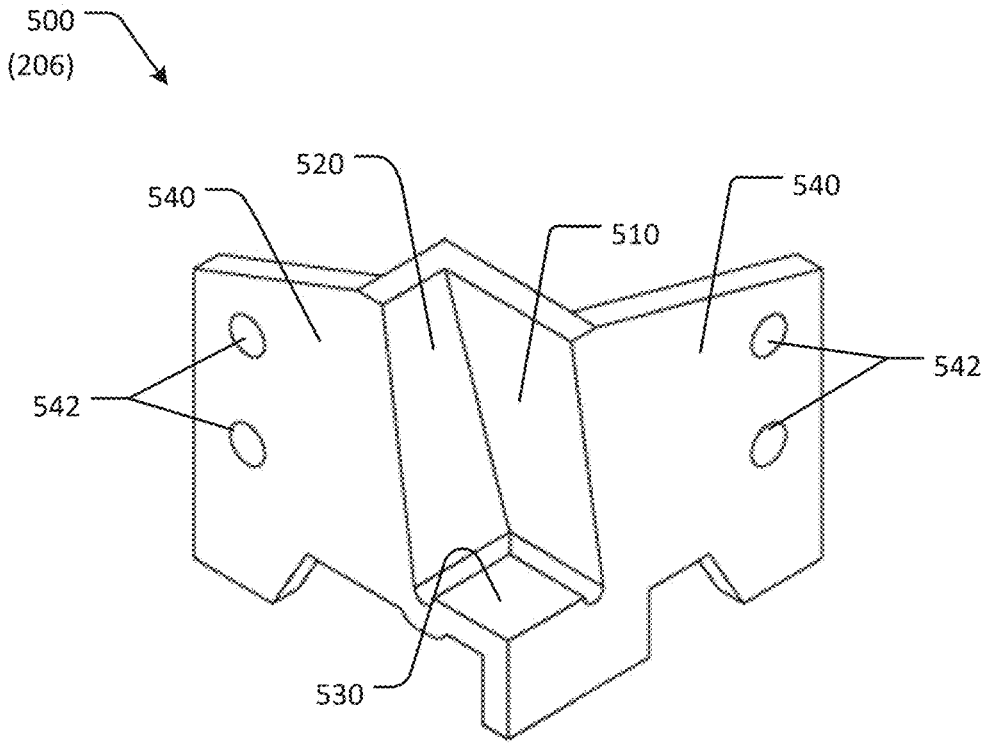
FIG. 8 is a perspective view of an left-handed undercut corner piece for the frame of FIG. 2, according to some embodiments.

FIGS. 8 and 9 show undercut embodiments of a corner piece 500. In particular, FIG. 8 shows a "left-hand" undercut embodiment of the corner piece 500, and FIG. 9 shows a "right-hand" undercut embodiment of the corner piece 500. The requirement for left-handed and right-handed (i.e. mirrored) undercut embodiments is as a result of the relative geometry of the junction where undercut and drawcut sides meet. In embodiments where an undercut is only at one end of the frame 200, and the rest of the frame 200 has a drawcut configuration, mirrored versions of the undercut corner pieces are required.

The corner pieces 500 comprise an undercut wall 510, a drawcut wall 520, and a ledge 530 which extends from the walls 510, 520 at an undercut angle and at a drawcut angle. The undercut angle is the angle between the undercut wall 510 and the ledge 530. The drawcut angle is the angle between the drawcut wall 520 and the ledge 530. The undercut and drawcut angles correspond to the undercut and drawcut angles of the individual covers 900 which are in contact with the corner pieces 500. The ledge 530 supports the bottom edge (reverse surface 912) of the individual cover 900.

Figure 10:
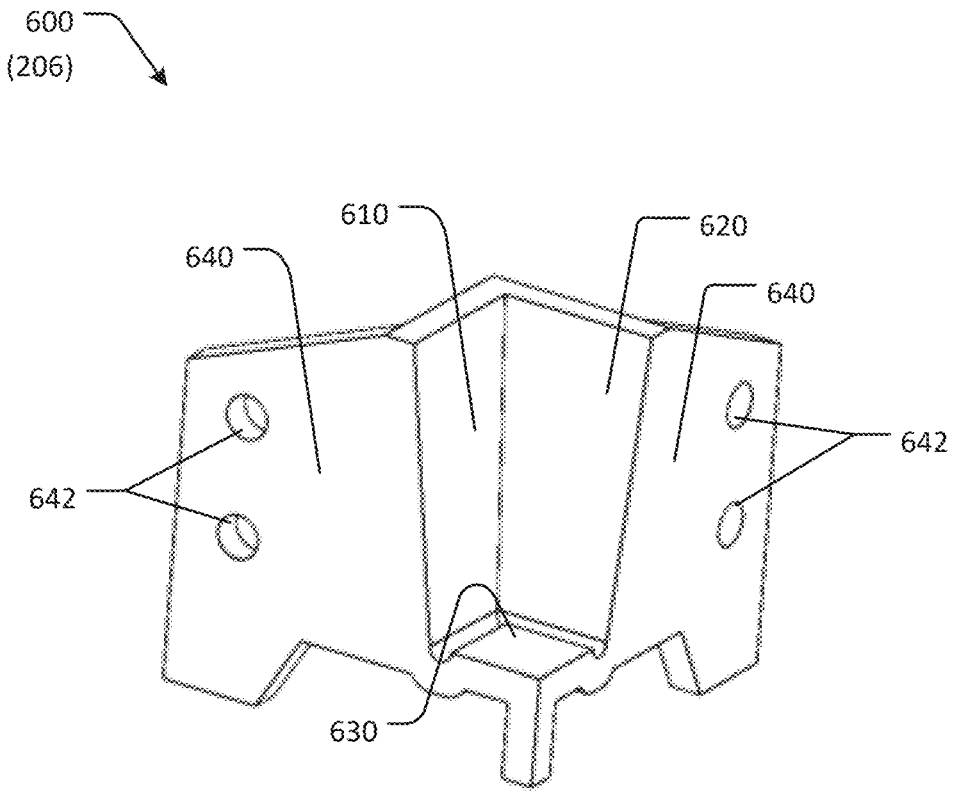
FIG. 10 is a perspective view of a drawcut corner piece for the frame of FIG. 2, according to some embodiments.

FIG. 10 shows a drawcut embodiment of a corner piece 600, where two drawcut walls 610, 620 meet. As the drawcut sides 610, 620 are symmetrical in their angles, it is possible to simply rotate the drawcut corner piece 600 to fit on opposing drawcut corners of the frame 200 and no mirrored versions are required. The corner piece 600 further comprises a ledge 630 which extends from the walls 610, 620 at a drawcut angle. The drawcut angle is the angle between the drawcut walls 610, 620 and the ledge 630. The drawcut angle corresponds to the drawcut angle of the individual cover 900 which is in contact with the corner piece 600. The ledge supports the bottom edge (reverse surface 912) of the individual cover 900.

The corner pieces 500, 600 further comprise respective end plates 540, 640. The end plates 540, 640 are placed at the ends of the walls 510, 520, 610, 620 and the ledges 530, 630 to demarcate the end of the corner pieces 500, 600 and provide some support to maintain the angle between the walls 510, 520, 610, 620 and respective ledges 530, 630. The end plate 540, 640 also provides a location for connecting adjacent frame pieces 300, 400. A series of holes 542, 642 may be formed in the end plate 540, 640 so as to accommodate a fastener, such as a bolt, and a nut tightened onto the bolt to adjoin and retain the end plate of the corner piece 500, 600 with the end plate 540, 640 of the adjacent frame piece 300, 400. The end plates 540, 640 are positioned relative to each other at a corner angle, which is typically 90°, although other angles are possible depending on the desired shape of the frame 200.

FIG. 11 is an exploded view showing the support beam 700, wall boxes 800, and wall box base plates 850. The support beam 700 comprises a first flange 710, a second flange 720, and a web 730. The beam 700 comprises oppositely disposed first and second ends 702, 704, with a plurality of stiffening plates 740 disposed along the beam 700 between the first and second ends 702, 704 to improve the resistance of the beam 700 to applied loads such as bending and torsion. The first flange 710, second flange 720, and web 730 may be arranged as per a conventional I-beam, as can be more clearly seen in FIG. 12.

Figure 12:
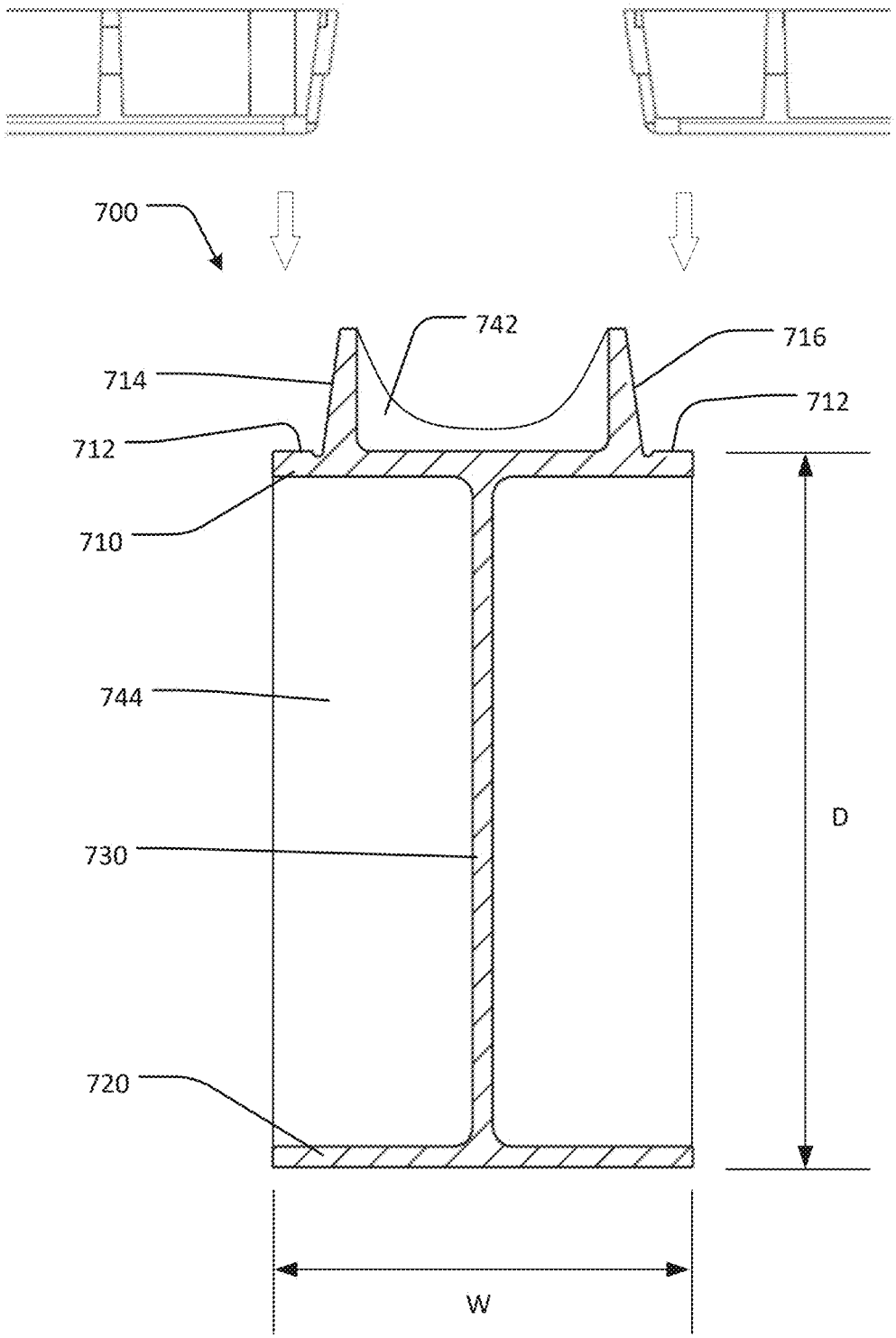
FIG. 12 is a section view of the support beam of FIG. 11, according to some embodiments.

FIG. 12 is a partial cross-section view of the beam 700, with the ends 702, 704 of the beam 700 hidden to more clearly show the profile of the flanges 710, 720 and web 730, and the placement of the stiffening plates 740. The beam 700 has a depth, D, as measured between the first and second flanges 710, 720 parallel to the web 730. The beam 700 has a width, W, as measured between the respective extremities of the first and second flanges 710, 720 perpendicular to the web 730. The depth D and width W of the beam 700 may range in size depending on various factors, such as the material properties of the beam 700, the length of the beam 700, and the amount of load to be carried by the beam 700. In some embodiments, the depth D may be in the range of approximately 50 mm to 4000 mm, depending on the load class. In some embodiments, the width W may be in the range of approximately 500 mm to 1000 mm, depending on the load class. For example, a Class F or G-rated assembly 100 may have a beam 700 measuring 4000 mm deep and 1000 mm wide.

The first flange 710 defines a support surface 712 for supporting an edge of at least one of the individual modular access covers. When assembled as part of the frame 200, the support surface 712 is coincident with the support plane 340, 440. The first flange 710 may also have a pair of ridges 714, 716 which extend generally perpendicularly from the first flange 710. The ridges 714, 716 restrict the lateral movement of the individual covers when the covers are placed in contact with the support surface 712, as indicated by arrows 718. The ridges 714, 716 are angled relative to the support surface 712 to form a drawcut which corresponds to the drawcut angle of the covers. The support surface 712 may comprise first and second laterally opposite support surfaces, which are separated by the ridges 714, 716.

A ridge stiffening plate 742 connects the ridges 714, 716 to reinforce the ridges 714, 716 against lateral forces imposed by the covers. The flanges 710, 720 are joined by the web 730 and a pair of web stiffening plates 744 disposed either side of the web 730. Several pairs of the web stiffening plates 744 may be disposed along the length of the beam 700 between the first and second ends 702, 704. This essentially partitions the longer flange 710, 720 into a series of shorter flanges, which has a higher resistance to bending for a given load.

FIG. 11 shows the placement of the web stiffening plates 744 along the length of the beam 700. FIG. 11, which shows a beam 700 measuring approximately 3 m long, has 21 of ridge stiffening plate 742 and three pairs of web stiffening plates 744 distributed along its length. The three pairs of web stiffening plates 744 may be distributed so that there is a pair of web stiffening plates 744 toward each end 702, 704 of the beam 700, and a pair of web stiffening plates 744 approximately at the middle of the beam 700.

The number of stiffening plates 742, 744 can be adjusted depending on the length of the beam 700. For example, a 1.5 m long beam 700 may have 11 of ridge stiffening plate 742 and three of web stiffening plates 744. The beam 700 may also come in 2 m and 2.5 m lengths, although varying lengths of beams may be made depending on the size of the opening to be covered.

Continuing to refer to FIG. 11, the web 730 tapers upwardly towards the first and second ends 702, 704 of the support beam 700. Tapering the web 730 allows for a deeper beam in the midsection of the beam 700, where the bending moments and shear stresses are highest, and a shallower beam at the ends 702, 704 where the moments and stresses are at their lowest. Having a shallower beam at the ends 702, 704 also allows the ends of the beam 700 to better fit into the frame 200. By fitting the first and second ends 702, 704 of the beam 700 into the frame 200, this reduces or removes the need to build a deep rebate into the surrounding structure to accommodate the full depth of the beam 700. Accordingly, only a small (and single size of) rebate is required for the frame 200, which reduces build time, complexity, and cost on site.

The tapering of the web 730 may begin at the end-most plates 744 and end at the first and second ends 702, 704, thereby defining first and second tapered portions 732, 734 of the web 730, respectively. In the first and second tapered portions 732, 734, the second flange 720 angles towards the first flange 710. A first and second end plate 736, 738 may connect the first and second flanges 710, 720. The web 730 may also define a first lifting aperture 746 at the first end 702 of the support beam 700, and a second lifting aperture 748 at the second end 704 of the support beam 700. The lifting apertures 746, 748 may be located in the tapered portions 732, 734.

At the first and second ends 702, 704 of the beam 700, the first flange 710 extends beyond the end plates 736, 738 to terminate in a first wall 750 at the first end 702, and terminate in a second wall 752 at the second end 704. The ridges 714, 716 may adjoin the first and second end walls 750, 752. The first and second walls 750, 752 are angled relative to the support surface 712 of the first flange 710. Where the angle between the walls 750, 752 and the support surface 712 is an acute angle, an undercut configuration is formed. Where the angle between the walls 750, 752 and the support surface 712 is an obtuse angle, a drawcut configuration is formed. In some embodiments, the first end 702 of the beam 700 is undercut to correspond to the undercut at the first end 210 of the frame 200. In some embodiments, the second end 704 of the beam 700 is drawcut to correspond to the drawcut at the second end 220 of the frame 200.

The first and second walls 750, 752 may extend to form respective first and second box structures 754, 756. The first and second box structures 754, 756 are shaped to have substantially the same depth as the frame pieces 300, 400 so that the rebate formed in the structure surrounding the opening can be a consistent size and shape.

A first end surface 760 may be defined on the underside of the first flange 710 at the first end 702 of the support beam 700, spanning from the first end plate 736 to the extremity of the beam 700 at the first end. Similarly, a second end surface 762 may be defined on the underside of the second flange 720 at the second end 704 of the support beam 700, spanning from the second end plate 738 to the extremity of the beam 700 at the second end. The first and second end surfaces 760, 762 may be substantially coplanar with the support surface 712, or parallel to and slightly offset therefrom.

As can be seen in FIG. 11, the wall box 800 is shaped to conform to the shape of the first and second box structures 754, 756. The wall box 800 comprises a base plate 850 for attaching the wall box 800 to the frame pieces 300, 400. When the support frame 200 is assembled, the wall box 800 envelops the box structure 754, 756, and the wall box base plate 850 adjoins the wall box 800 and the respective end surface 760, 762.

Figure 13:
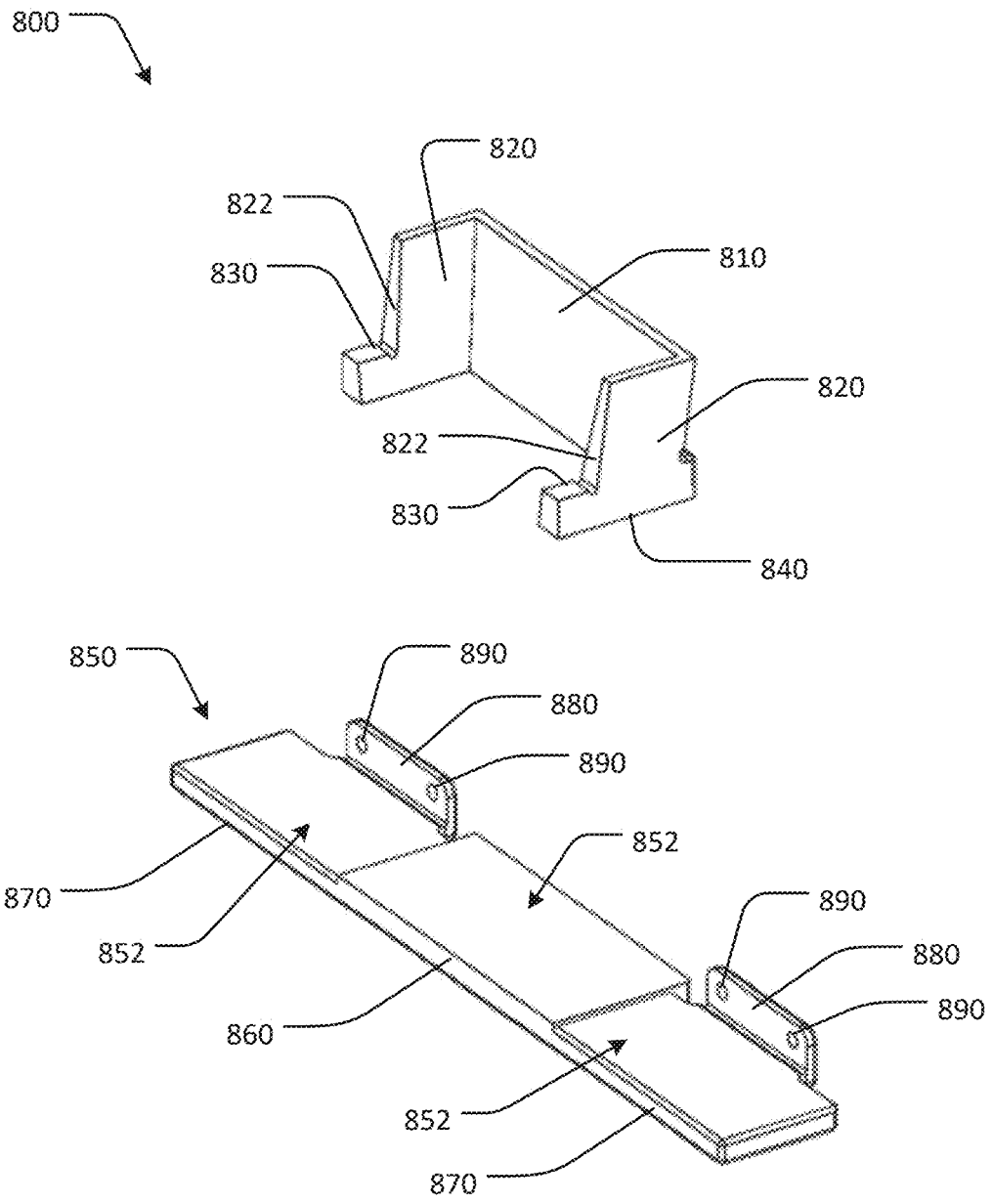
FIG. 13 is a perspective view of the wall boxes of FIG. 11, according to some embodiments.

Turning now to FIG. 13, the wall box 800 comprises a wall 810 and end plates 820 extending perpendicularly at each end of the wall 810. The wall 810 and end plates 820 are angled relative to each other to accommodate the drawcut of the box structure 754, 756. The end plates 820 may also have an end face 822, and a step 830 extending from the end face 822 at the same angle as the angles 330, 430 to define an undercut or drawcut configuration. When the wall box 800 is assembled as part of the frame 200, the wall box step 830 sits level with the ledge 320, 420, and the end face 822 sits level with the wall 310, 410 of the frame piece. The wall box 800 further comprises a base plate 850 for attaching the wall box 800 to the frame pieces 300, 400. The wall 810 and end plates 820 define a mating surface 840 which is attached to the base plate 850.

The wall box base plate defines a surface 852 to support the support beam 700 and the end frame pieces 202. The surface 852 is offset from the support plane 340, 440 by the height of the step 830. The height of the step 830 is equivalent to the height of the lip 380, 480 of the end frame pieces 202, so that the wall box step 830 sits level with the ledge 320, 420 (with which support plane 340, 440 is coincident). The height of the step 830, and thereby the offset of surface 852 from the support plane 340, 440, may be between 10 mm to 100 mm, such as 15 mm to 40 mm or 20 mm to 35 mm, for example. In some embodiments, the height of the step 830 is approximately 27 mm. The base plate 850 comprises a central portion 860 and wings 870 extending both sides of the central portion 860. In use, the mating surface 840 is coupled to the central portion 860, and the first and second end surfaces 760, 762 of the support beam 700 rest on the central portion 860. The wings 870 may comprise a flap 880 extending perpendicularly to the wings 870. The flap 880 may allow the base plate 850 to be connected to the frame pieces 300, 400 via apertures 890 defined in the flap 880. As can be seen in FIG. 2, when frame 200 is assembled, the end frame piece 202 sits on the wings 870. With additional reference to FIGS. 5 and 7, the wall box base plate 850 sits on the step 392, and packers may be placed in the gap between the top of the step 392 and the bottom of the frame pieces 202, 204 to support the frame pieces 202, 204. The use of packers allows the step 392 to be cut as a flat surface, and may be placed under the frame pieces 202, 204 at intervals of 200 mm to 300 mm to support the frame pieces 202, 204.

FIG. 14 shows an embodiment of one of the modular access covers 900 which is joined to other covers 900 to form the first and second sets of covers 110, 120. The cover 900 comprises a base plate 910 having first and second end walls 920, 930 and side walls 940 extending from the base plate. The first and second end walls 920, 930 may be oppositely disposed to each other, and the side walls 940 connect the end walls 920, 930 to define a cavity 950 with the base plate 910. The base plate 910 comprises a reverse surface 912 disposed opposite the cavity 950, which defines an underside of the cover 900. The reverse surface 912 may be substantially flat and smooth.

In some embodiments, the cover 900 is rectangular. The angle between the end walls 920, 930 and the base plate 910, and the angle between the side walls 940 and the base plate 910 may be in the region of 70° to 110° to define an undercut or drawcut configuration. For example, a suitable angle would be 98°.

The cover 900 further comprises ribs 960 disposed on the base plate 910. The ribs 960 may be arranged in a grid pattern, such as shown in FIG. 14. The ribs 960 may extend generally perpendicularly from the base plate 910 and connect to the end walls 920, 930 and side walls 940 to divide the cavity 950 into a series of smaller cavities 950. The cavity or cavities 950 are configured to receive and contain a filler material, such as cement or concrete. Filling the cavities 950 with a filler material increases the strength and the weight of the cover 900, and allows a smooth, flat contact surface to be created on the cover 900. In use, a load can be applied to the contact surface without falling into the cavities 950. A non-slip or high-friction coating may be applied to the contact surface to improve grip, for example when walking on the cover 900.

The cover 900 further comprises a connecting portion 970. The connecting portion 970 is configured to fixedly couple the cover 900 to an adjacent cover 900. The connecting portion 970 may extend from one or more of the end walls 920, 930. In some embodiments, the connecting portion 970 may extend from one or more of the side walls 940, or a combination of side walls 940 and the end walls 920, 930. One or more of the connecting portions 970 may be attached to one or more of the ribs 960 for additional rigidity.

In some embodiments, the base plate 910, end walls 920, 930, side walls 940, ribs 960, and connecting portion 970 are integrally formed, for example by moulding or casting, to reduce the need to manufacture and assemble separate parts. The base plate 910 may define at least one aperture 914 extending from the cavity 950 through to the reverse surface 912. The aperture 914 may provide drainage for any liquid contained in the cavity 950, if the cavity 950 has not been filled with filler material. In embodiments of the cover 900 where casting/moulding of molten material is used to form the cover 900, the aperture 914 may allow for stress and heat to dissipate as the cover 900 cools. The end walls 920, 930, side walls 940, ribs 960, and connecting portion 970 may be of substantially equal height. In some embodiments, the ribs 960 and/or the connecting portion 970 are shorter than the height of the end walls 920, 930 and side walls 940.

The cover 900 has a length L, as measured between the first and second end walls 920, 930. The cover 900 has a width W, as measured between the side walls 940. The cover 900 has a depth D, as measured between the top of the first and second end walls 920, 930 and the reverse surface 912. The length L and width W of the cover 900 may range between approximately 125 mm to approximately 1000 mm. The depth D of the cover 900 may range between approximately 50 mm to approximately 100 mm. In some embodiments, the cover 900 may be made in a variety of set sizes which, when combined, can be used to cater to the majority of opening sizes and shapes. This reduces the amount of custom covers required to be made for each opening to be covered. The approximate set sizes in millimetres of the cover 900 may be (L×W×D): (1) 750×125×73; (2) 500×250×73; (3) 750×750×81; (4) 1000×125×73; (5) 500×750×73; (6) 500×500×73. However, other sizes of covers 900 may be manufactured if required.

In some embodiments, the cover 900 further comprises a tab 980. The tab 980 is configured to engage with the connecting portion 970 to allow coupling of adjacent covers 900 together. The tab 980 comprises a tab body 982 which substantially spans the length of the first end wall 920 and defines a tab hole 984. The tab body 982 may additionally define a supporting surface 986. The reverse surface 912 and the supporting surface 986 may be substantially coplanar. In some embodiments, the reverse surface 912 and the supporting surface 986 are parallel and offset from each other.

The tab 980 and the connecting portion 970 cooperate as part of the retainer 130 (previously described in relation to FIG. 1) to maintain the desired level of contact between adjacent covers 900 when the covers 900 are placed under load. In particular, the tab 980 extends outwards from the first end wall 920 along part of the length of the first end wall 920. In some embodiments, the length of the tab body 982 is at least approximately 50% of the length of the first end wall 920. The length of the tab body 982 may be at least approximately 70% of the length of the first end wall 920. A longer tab body 982 provides greater contact area with the first end wall 920 and allows the tab 980 to be more sturdily supported by the first end wall 920. However, the length of the tab 980 should not cause to the tab 980 to interfere with the ledge 320, 420 of the frame pieces 300, 400 when the cover 900 is being placed into the frame 200. If the tab 980 is too long, it will interfere with the ledge 320, 420 as the tab 980 is being tucked under the adjacent cover 900.

Figure 15A:
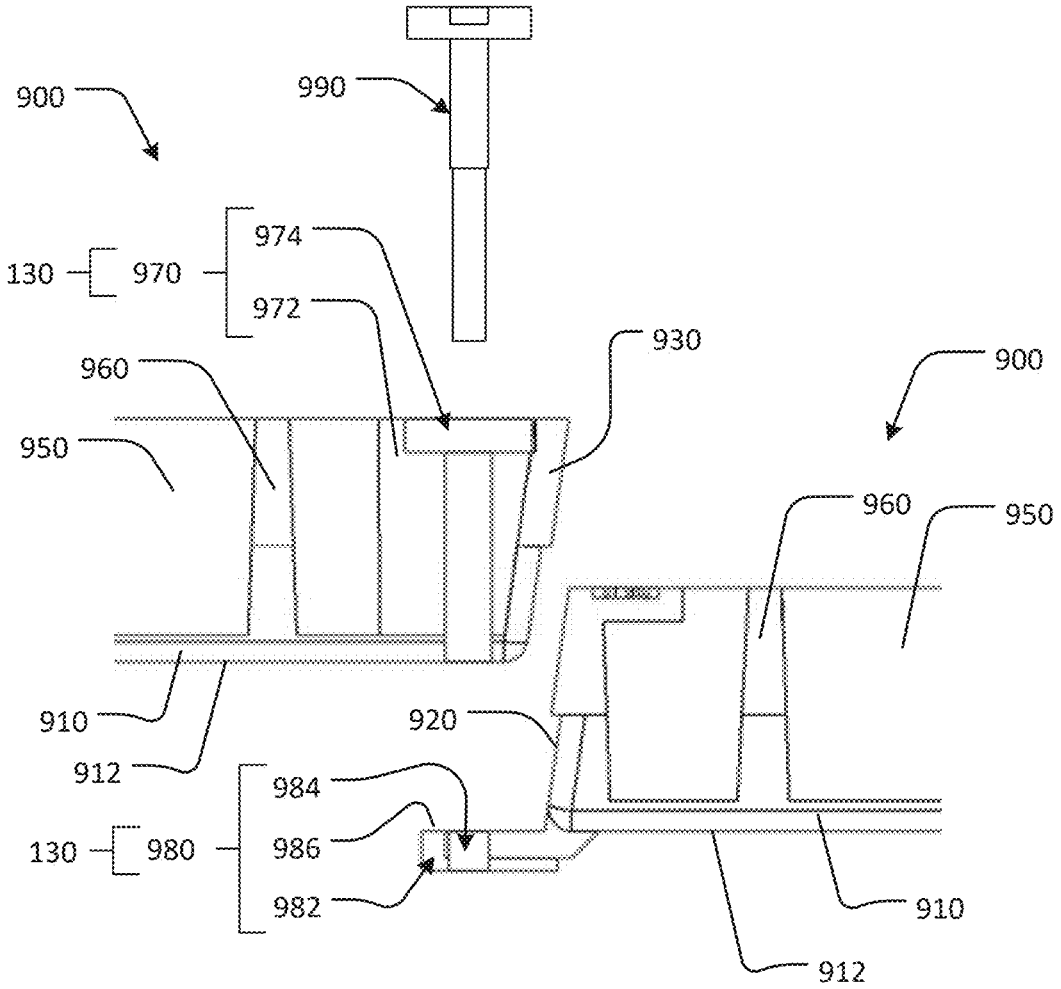
FIG. 15A is a section view of the covers of FIG. 1, showing a first step in their assembly, according to some embodiments.
Figure 15B:
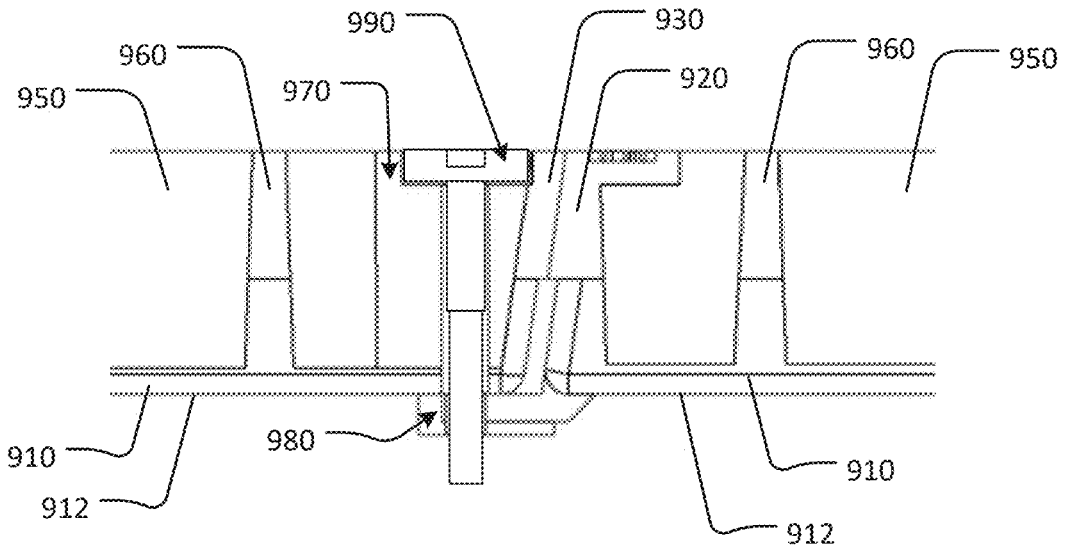
FIG. 15B is the section view of FIG. 15A, showing a subsequent step in the assembly of the covers, according to some embodiments.

The tab 980 may extend outwards an equal distance from the first end wall 920 along the length of the tab body 982 so that the area of supporting surface 986 is relatively consistent along the length of the tab body 982. As shown in FIGS. 15A and 15B, when covers 900 are placed adjacent to each other, the connecting portion 970 of one cover 900 overlaps the tab 980 of the other cover 900, so that the reverse surface 912 of one cover 900 contacts the supporting surface 986 of the other cover 900.

FIG. 15A is an exploded cross-section detail view of adjacent covers 900. The connecting portion 970 may be formed as an integral part of cover 900 when it is cast. The connecting portion 970 comprises a body 972 which defines a bore 974. The bore 974 extends through the reverse surface 912 of the cover 900. The bore 974 is configured to receive a connector or fastener 990 and guide the connector 990 to engage with the tab hole 984 and thereby fixedly couple the covers 900, as shown in FIG. 15B. In some embodiments, the tab hole 984 is threaded so that the connector 990 may engage and retain the tab 980, as in use, the underside of the cover 900 is not accessible for a nut to be tightened over the end of the bolt 990.

FIG. 15B is the cross-section view of FIG. 15A with the adjacent covers 900 coupled to each other. As shown, the second end wall 930 and reverse surface 912 of one cover 900 is placed adjacent to the first end wall 920 and supporting surface 986 of another cover 900, and the bore 974 of the connecting portion 970 is aligned with the tab hole 984 to receive a connector 990 therethrough. The connector 990 may be a removable fastener, such as a bolt, to fixedly but releasably couple the covers 900 together.

Figure 16A:
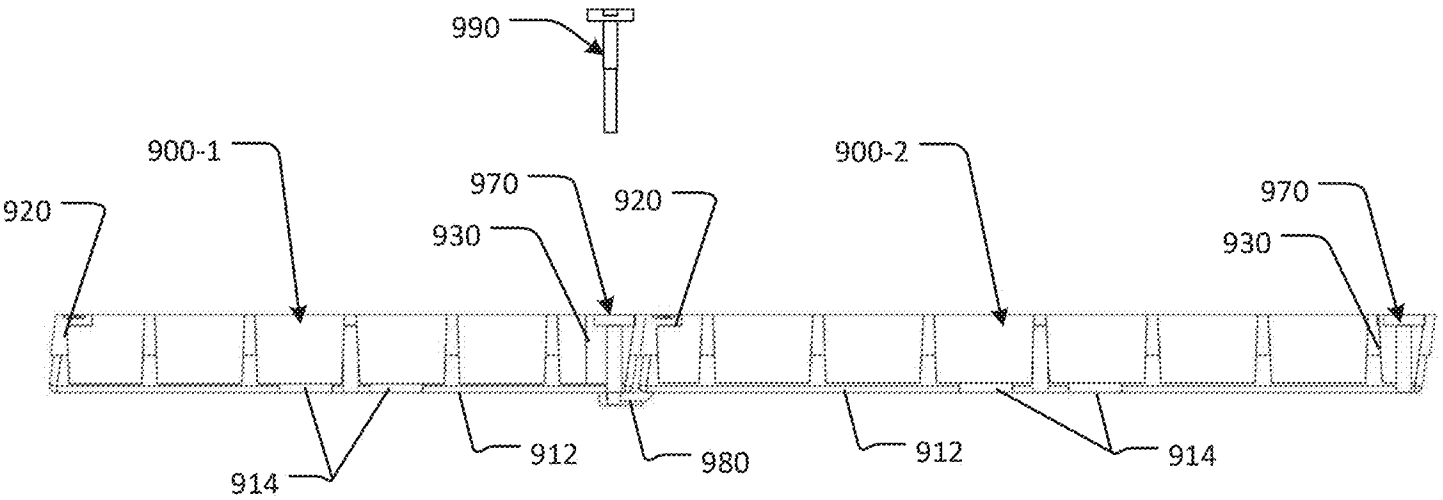
FIG. 16A is a section view of the modular access cover of FIG. 1, showing the disassembly of the covers, according to some embodiments.
Figure 16B:
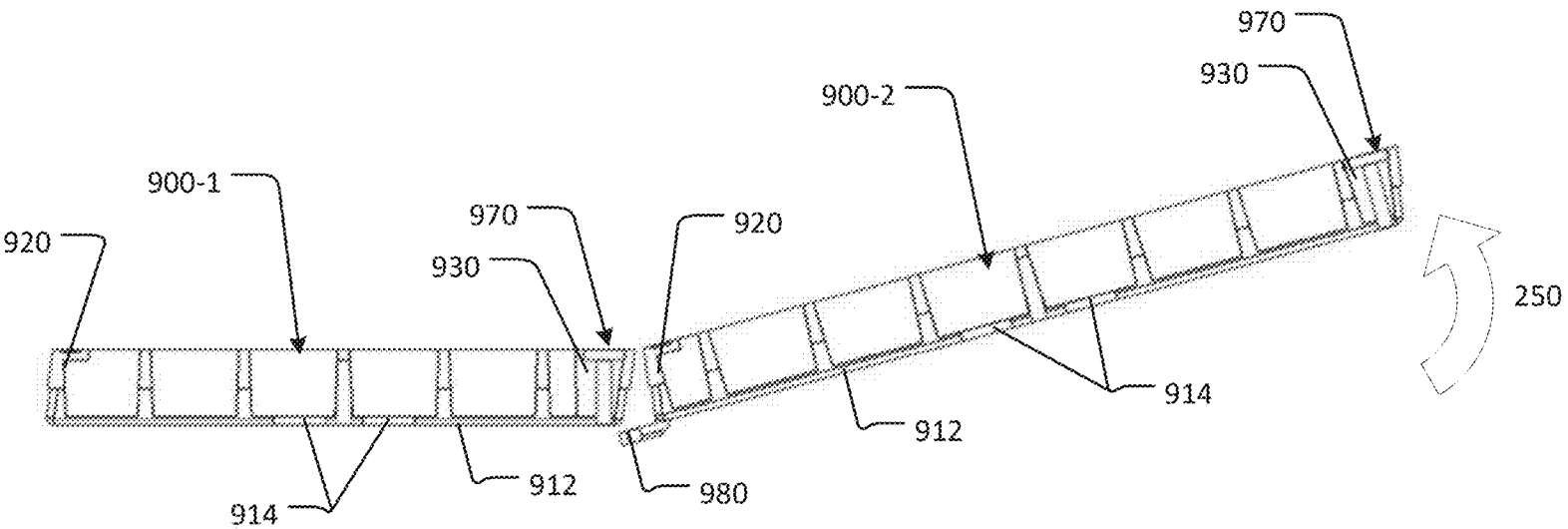
FIG. 16B is the same section view of FIG. 16A, showing a subsequent step in the disassembly of the covers, according to some embodiments.

Removing the connector 990 allows the covers 900 to be detached from each other. Once the covers 900 are detached, individual covers 900 may be detached from the support beam 700 and the end and side frame pieces 202, 204 to permit access through the opening to the underground or underfloor area covered by the assembly 100. FIGS. 16A and 16B show the detachment of one cover 900 from another cover 900; for clarity, the frame 200 is not shown. To detach connected covers 900, the connector 990 is first removed, as shown in FIG. 16A. As marked by arrow 250 in FIG. 16B, the cover 900 may then be tilted up at the second end wall 930 to separate the tab 980 from the reverse surface 912 of the adjacent cover 900, and the cover 900 removed. This is essentially the reverse operation shown in FIG. 3B. The size and weight of the covers 900 may deter the risk of unauthorised removal, or accidental dislodgement when a heavy vehicle travels over it. However, the covers 900 may thus be too heavy to safely lift manually, and so powered lifting equipment such as hydraulic jacks or cranes may be used to lift the covers 900.

In the first and second sets of covers 110, 120, all the individual covers 900 have the tab 980, with the exception of the covers 900 at the first end 210 which engage with the undercut in the frame. As shown FIGS. 16A and 16B (and FIGS. 3A and 3B), in the endmost cover 900 in the first and second sets 110, 120 does not have the tab 980, as it is supported on all sides by the frame 200 or the tab 980 of the adjacent cover.

The frame piece 300, 400, corner piece 500A, 500B, 600, beam 700, wall box 800, and cover 900 may be made from the same material as each other, or made from different materials to each other. The frame piece 300, 400, corner piece 500A, 500B, 600, beam 700, wall box 800, and cover 900 may be made from a rigid material such as metal, plastic, fibreglass or composite. In some embodiments, the frame piece 300, 400, corner piece 500A, 500B, 600, beam 700, wall box 800, and cover 900 may be made from a combination of these materials. Preferably, the frame piece 300, 400, corner piece 500A, 500B, 600, beam 700, wall box 800, and cover 900 is made from steel. The steel may be galvanised or painted to resist corrosion. The frame piece 300, 400, corner piece 500A, 500B, 600, beam 700, wall box 800, and cover 900 may be made from several parts which are attached together, such as by welding. The wall and ledge of the frame piece 300, 400 and corner piece 500A, 500B, 600 may be extruded so that the angle between the wall and the ledge is accurately formed in order to accommodate the corresponding undercut or drawcut of the individual cover. The end plates and the stiffeners may then be welded to the wall and ledge. In some embodiments, the frame piece 300, 400 is a single body, wherein the wall and ledge, base plate, stiffeners, and end plates are integrally formed to avoid the need to attach multiple pieces together. Similarly, the corner piece 500A, 500B, 600, beam 700, wall box 800, and cover 900 may be integrally-formed, single bodies. Forming the frame piece 300, 400, corner piece 500A, 500B, 600, beam 700, wall box 800, and cover 900 as single bodies may be achieved by casting the steel, injection moulding the plastic, or laying the fibreglass in a corresponding mould.

Figure 17:
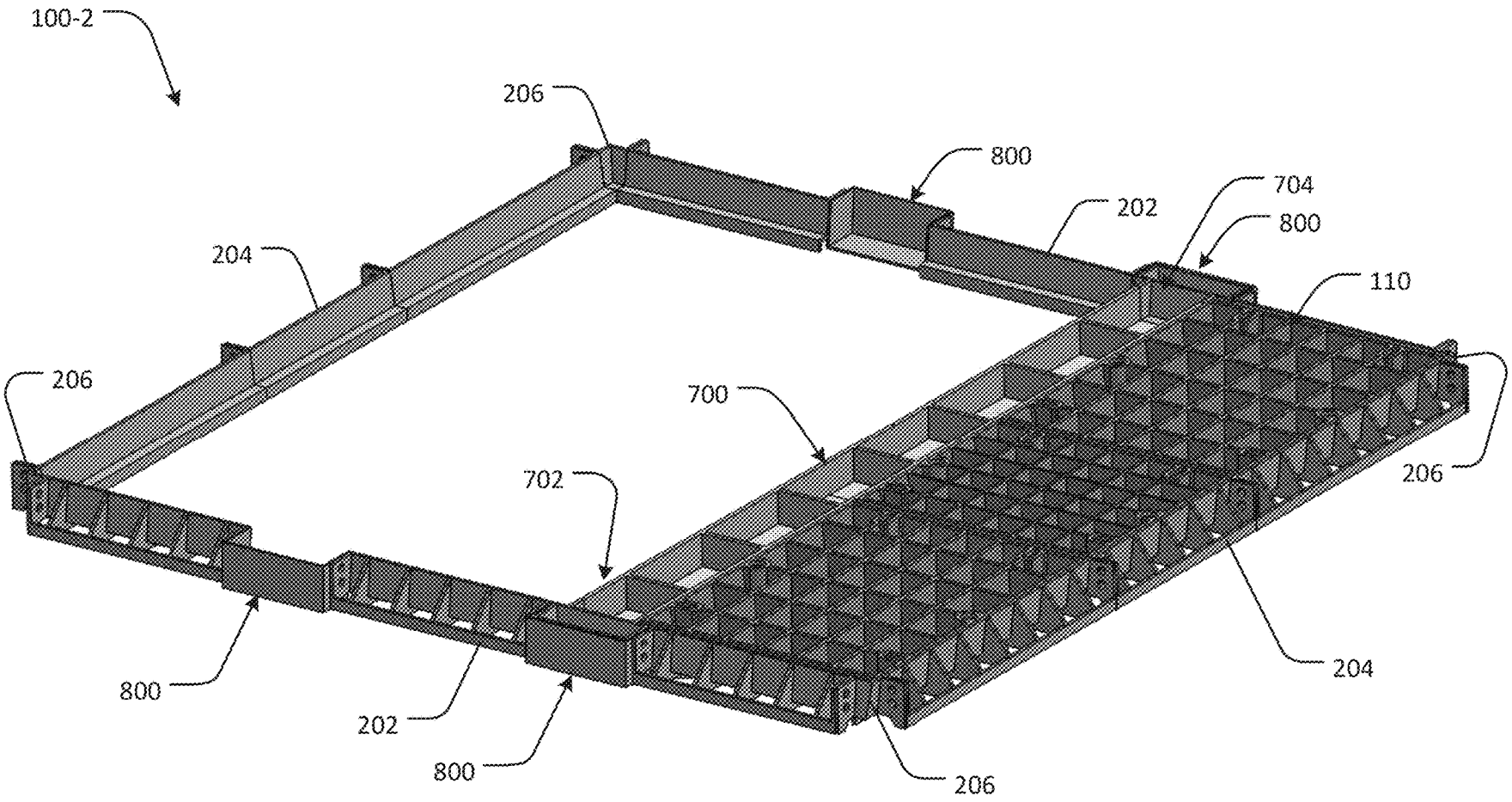
FIG. 17 is a perspective view of a modular access cover assembly comprising two pairs of wall boxes configured to support two support beams, according to some embodiments.

In some embodiments, the assembly 100-2 may include multiple laterally spaced and parallel support beams 700. Sets of access covers 900 are positionable on each lateral side of each of the multiple support beams 700. FIG. 17 is a perspective view of a modular access cover assembly 100-2, according to some embodiments. As shown in FIG. 17, the assembly 100-2 shows the support frame 200, a single set of covers 110, and one support beam 700 supported by a first pair of wall boxes 800. The support frame 200 additionally includes a second pair of wall boxes 800 spaced laterally from the first pair of wall boxes. The second pair of wall boxes 800 is configured to receive the ends of a second support beam 700 that is parallel to and laterally spaced from the first support beam 700. By having two pairs of wall boxes 800, the support frame 200 is configured to include two support beams 700 and three sets of access covers 900, with each support beam 700 having a set of access covers 900 on each lateral side thereof. The use of multiple support beams 700 may be desirable to allow a larger opening to be covered. The assembly 100-2 is otherwise identical to the assembly 100 described above.

Figure 18:
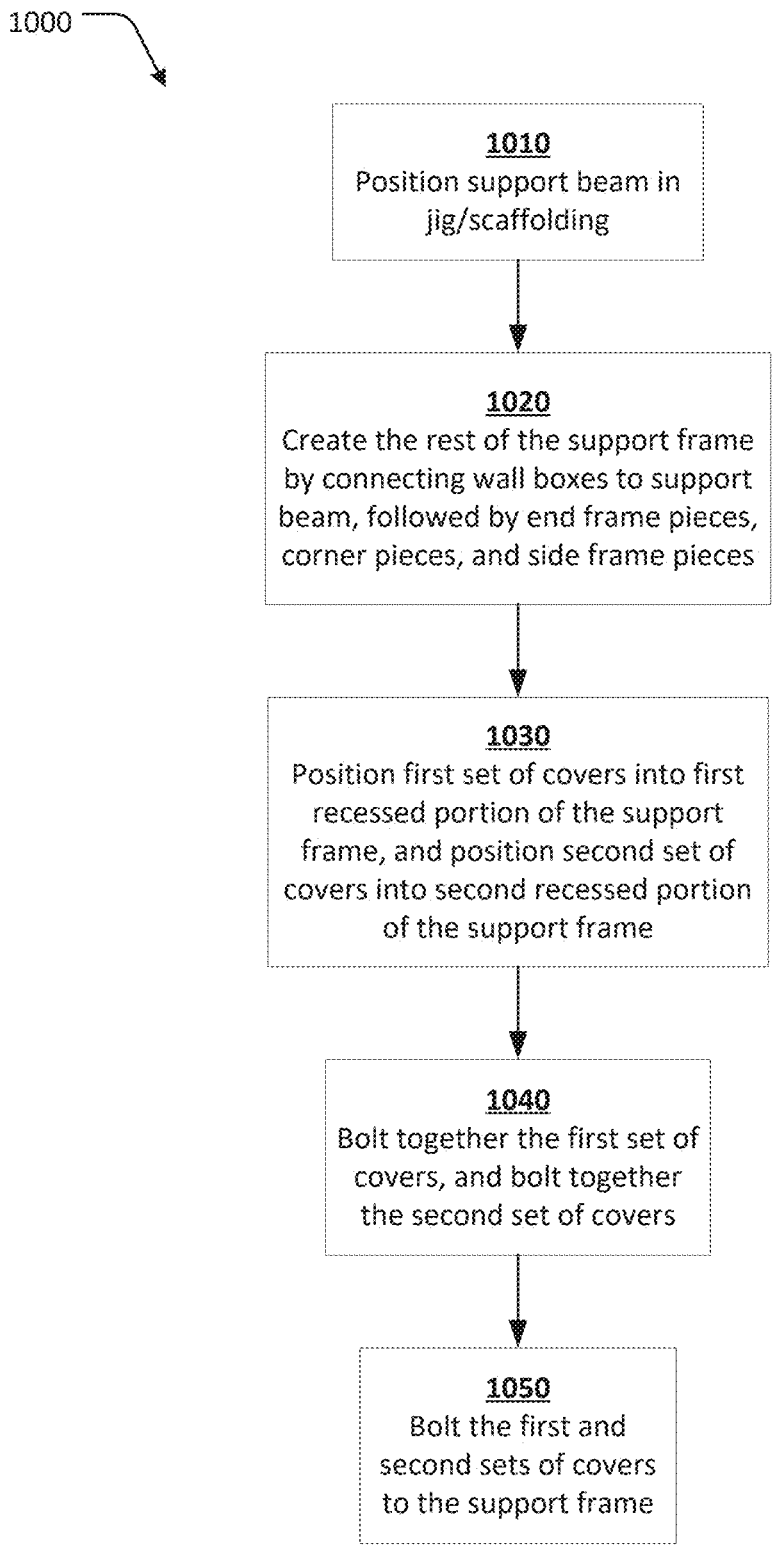
FIG. 18 is a block diagram of a method for assembling the assembly of FIG. 1, according to some embodiments.

FIG. 18 is a flow chart of a method 1000 for assembling the access cover assembly 100. At 1010, at jig or scaffolding may be used to hold the various pieces of the frame 200 in position while connecting the pieces together. In some embodiments, the beam 700 is the heaviest and bulkiest piece of the frame 200, and so is the first piece located in the jig, with the other frame pieces built around the beam 700.

At 1020, the method 1000 involves connecting the wall boxes 800 to the support beam 700, and then connecting the end frame pieces 202 to the wall boxes 800. The corner pieces 206 may then be attached to the end frame pieces 202, and then the side frame pieces 204 attached to the corner pieces 206 to form the support frame 200. Removable fasteners such as nuts and bolts may be used to connect the various pieces of the frame 200. In some embodiments, a plurality of the end frame pieces 202 are connected together. In some embodiments, a plurality of the side frame pieces 204 are connected together. The end and side frame pieces 202, 204 are connected by the corner pieces 206. A spirit level may be used to ensure the frame 200 has been assembled evenly.

Once the frame 200 is assembled, the covers 900 may be inserted individually into the recessed portions 208 of the frame 200. Alternatively, the individual covers 900 may be preassembled to form the first set of covers 110 and the second set of covers 120, before assembling the sets 110, 120 with the frame 200. The edges of the covers 900 are supported on the ledges 320, 420 and may be substantially coincident with the support plane 340, 440.

At 1030, the method 1000 may additionally involve positioning the first set and the second set of covers 110, 120 in the first and second recessed portions 208-1, 208-2 respectively. The method 1000 may further involve, at 1040, bolting the first set of covers 110 together, and bolting the second set of covers 120 together. At 1050, the method 1000 may involve bolting the first and second sets 110, 120 to the frame 200 to secure the first and second sets 110, 120 in the respective first and second recessed portions 208-1, 208-2.

The assembly 100 may be assembled according to the method 1000 in a factory, and then transported to site. Fully tightening the nuts to secure the bolts is recommended prior to transport to reduce the risk of the assembly 100 separating into its constituent parts. In some embodiments of method 1000, the assembly 100 is instead assembled at the installation site, which avoids the need to transport the assembly 100, especially if the assembly 100 is too large to be cost-effectively transported.

The assembly 100 caters for a large variety of opening sizes and shapes using a few modular parts. For example, around six different cover sizes may be combined to cover a variety of opening sizes and shapes. Assembly may involve the assembly of approximately 20-30 parts which are bolted together to cover a variety of opening sizes and shapes. The parts, methods, and assemblies disclosed herein may reduce the complexity and assembly time compared to conventional multi-part access covers.

In particular, the present disclosure provides a tapered beam which fits into the frame, meaning only a single, smaller rebate is required to be built on site to support the assembly 100. In conventional multi-part systems, beams have a consistent depth along the length of the beam, and typically, the depth of the beam is considerably larger than the depth of the cover to allow the beam to provide the desired resistance to bending loads. This means that when an assembled access cover is installed on site, a step or rebate has to be formed or built into the concrete floor to accommodate the different depths of the beam and the covers.

The tapered beam may be cast or moulded as a single piece. The covers and frame pieces may also be moulded as single-piece constructions. This may minimise manufacturing errors compared to conventional multi-part access covers which use fabrication techniques such as cutting and welding to assemble a multi-part product.

Any discussion of documents, acts, materials, devices, articles or the like which has been included in the present specification is not to be taken as an admission that any or all of these matters form part of the prior art base or were common general knowledge in the field relevant to the present disclosure as it existed before the priority date of each of the appended claims.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive.

The invention claimed is:

1. An access cover assembly comprising:

a first set of modular access covers and a second set of modular access covers, wherein in each set, adjacent covers are coupled; and a support frame comprising end frame pieces, side frame pieces, wall boxes, and a support beam, the support beam comprising:

a first beam end disposed opposite a second beam end;

a web spanning the beam ends, the web connecting a first flange of the support beam to a second flange of the support beam;

wherein the web comprises first and second tapered portions, the tapered portions tapering so that the second flange angles towards the first flange at the first and second beam ends to define first and second box structures respectively;

wherein the first and second box structures have substantially a same depth as the end and side frame pieces;

wherein the end frame pieces and side frame pieces define a support plane to support the first and second sets of modular access covers;

wherein the wall boxes define a support surface to support the support beam and the end frame pieces, wherein the support surface is offset from the support plane and wherein the wall boxes are connected to the end frame pieces and the wall boxes receive the box structures at the respective beam ends of the support beam; and wherein the end frame pieces, side frame pieces and the support beam define first and second recessed portions of the support frame which respectively receive and support the first and second sets of modular access covers on the support plane.

2. The access cover assembly of claim 1, wherein the support beam divides the first set of modular access covers from the second set of modular access covers.

3. The access cover assembly of claim 1, wherein the support frame further comprises corner pieces, and wherein each one of the corner pieces connects the end frame pieces and the side frame pieces at an angle to define a corner of the support frame.

4. The access cover assembly of claim 3, wherein the end frame pieces, side frame pieces, wall boxes, and corner pieces each comprise a ledge that defines an upper surface which extends from a wall, wherein the upper surface of each ledge extends along and partly defines the support plane.

5. The access cover assembly of claim 4, wherein each one of the end frame pieces, side frame pieces, wall boxes, and corner pieces has:

(i) a drawcut configuration, wherein an angle between the wall and the ledge is an obtuse angle; or (ii) an undercut configuration, wherein the angle between the wall and the ledge is an acute angle.

6. The access cover assembly of claim 1, wherein the side frame pieces comprise a plurality of modular side frame members connected end-to-end.

7. The access cover assembly of claim 1, wherein at least one first modular access cover of the first set of modular access covers and at least one second modular access cover of the second set of modular access covers comprise: a base plate, oppositely disposed first and second end walls, and a first connecting portion disposed adjacent the first end wall.

8. The access cover assembly of claim 7, wherein the first connecting portion of each at least one first modular access cover and each at least one second modular access cover is configured to align with a second connecting portion adjacent the second end wall of an adjacent modular access cover to allow fixed coupling of adjacent modular access covers.

9. The access cover assembly of claim 8, wherein the second connecting portion includes a projecting tab that comprises a tab body which substantially spans part of a length of the second end wall.

10. The access cover assembly of claim 9, wherein the first connecting portion defines a bore, wherein the bore is configured to receive a connector and to guide the connector to engage with the tab body when the first connecting portion is aligned with the second connecting portion, to thereby fixedly couple the adjacent modular access covers.

11. The access cover assembly of claim 7, wherein the end walls and the first connecting portion of the at least one first modular access cover and/or the at least one second modular access cover are integrally formed with the base plate.

12. The access cover assembly of claim 7, wherein connected ones of the first set of modular access covers are detachable from each other and connected ones of the second set of modular access covers are detachable from each other.

13. The access cover assembly of claim 1, wherein the first set of modular access covers and the second set of modular access covers comprise different numbers and/or sizes of modular access covers.

14. The access cover assembly of claim 1, wherein the support frame is configured to be set into a concrete foundation which defines an opening to an underground or underfloor area.

15. The access cover assembly of claim 14, wherein the first and second sets of modular access covers and the support beam are detachable from the respective end and side frame pieces to permit access through the opening to the underground or underfloor area.

16. A support beam for an access cover assembly, the support beam comprising:

a support surface for supporting an edge of at least one modular access cover;

a first wall and a first end surface at a first end of the support beam, and a second wall and a second end surface at a second end of the support beam; and a plurality of stiffeners disposed along the support beam between the first and second ends;

wherein an angle between the first wall and the support surface is an obtuse angle to form a drawcut configuration;

wherein an angle between the second wall and the support surface is an acute angle to form an undercut configuration; and wherein the first and second end surfaces are configured to engage with first and second wall boxes, and the first and second end surfaces are substantially coplanar with the support surface.

17. The support beam of claim 16, wherein the support surface comprises first and second laterally opposite support surfaces.

18. The support beam of claim 16, wherein a web of the support beam defines a first lifting aperture at the first end of the support beam, and a second lifting aperture at the second end of the support beam.

19. The support beam of claim 18, wherein the web tapers at the first and second ends of the support beam.

20. A modular access cover, comprising:

a base plate having first and second end walls, and side walls;

ribs disposed on the base plate and connecting the end walls and side walls to define a series of cavities; and a connecting portion adjacent the second end wall;

wherein an angle between the first end wall and the base plate is an acute angle to form an undercut configuration, and wherein an angle between the second end wall and the base plate is an obtuse angle to form a drawcut configuration;

wherein the connecting portion is configured to allow fixed coupling of the modular access cover to an adjacent modular access cover; and wherein the series of cavities is configured to receive and contain a filler material.

* * * * *